US010415164B2

(12) United States Patent
Diaz et al.

(10) Patent No.: US 10,415,164 B2
(45) Date of Patent: Sep. 17, 2019

(54) UPPER-TORSO GARMENT WITH THREE-DIMENSIONAL KNIT STRUCTURES

(71) Applicant: NIKE, Inc., Beaverton, OR (US)

(72) Inventors: Josue Diaz, Portland, OR (US); Virginia Meckley, Hillsboro, OR (US); Paul R. Montgomery, Portland, OR (US); Nicole Rendone, Beaverton, OR (US); Andrea J. Staub, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 198 days.

(21) Appl. No.: 15/584,950

(22) Filed: May 2, 2017

(65) Prior Publication Data

US 2018/0317570 A1 Nov. 8, 2018

(51) Int. Cl.

| | |
|---|---|
| ***D04B 1/24*** | (2006.01) |
| ***A41C 3/00*** | (2006.01) |
| ***D04B 1/10*** | (2006.01) |
| *A41D 1/04* | (2006.01) |
| *A41D 1/22* | (2018.01) |

(52) U.S. Cl.

CPC ..... *D04B 1/246* (2013.01); *A41C 3/0014* (2013.01); *D04B 1/108* (2013.01); *A41D 1/04* (2013.01); *A41D 1/22* (2013.01); *A41D 2500/10* (2013.01)

(58) Field of Classification Search

CPC ..... D04B 1/246; D04B 1/102; D04B 7/28; D04B 9/08; D04B 1/18; A41C 3/0057; A41C 3/0007; A41C 3/0014

See application file for complete search history.

(56) References Cited

U.S. PATENT DOCUMENTS

| | | | | |
|---|---|---|---|---|
| 1,984,326 A | | 12/1934 | Titone | |
| 2,397,247 A | | 3/1946 | Davidson | |
| 2,707,381 A | | 5/1955 | Vincent | |
| 2,899,812 A | | 8/1959 | Attenborough | |
| 2,946,211 A | | 7/1960 | Morancy | |
| 3,092,987 A | * | 6/1963 | Levine | A41C 3/06 450/93 |
| 3,167,938 A | | 2/1965 | Seiler | |
| 3,241,340 A | | 3/1966 | Herbert | |

(Continued)

FOREIGN PATENT DOCUMENTS

| | | |
|---|---|---|
| DE | 2036542 A1 | 2/1972 |
| EP | 0261800 | 3/1988 |

(Continued)

OTHER PUBLICATIONS

Zheng, Rong, Winnie Yu, and Jintu Fan, "Pressure evaluation of 3D seamless knitted bras and conventional wired bras," Fibers and Polymers 10.1 (2009): 124-131. http://www.researchgate.net/profile/Winnie_Yu/publication/225481465; Pressure_evaluation_of_3D_seamless_knitted_bras_and_conventional_wired_bras/links/54d029160cf24601c0964062.pdf.

(Continued)

*Primary Examiner* — Danny Worrell

(74) *Attorney, Agent, or Firm* — Shook, Hardy & Bacon, LLP

(57) ABSTRACT

An upper-torso garment includes a chest-covering portion having a knit textile region, which includes a plurality of courses fully spanning a dome-shaped portion. In addition, the knit textile region includes a plurality of partial-length courses partially spanning the dome-shaped portion.

17 Claims, 17 Drawing Sheets

(56) References Cited

U.S. PATENT DOCUMENTS

| | | | | |
|---|---|---|---|---|
| 3,389,580 | A | 6/1968 | William et al. | |
| 3,500,665 | A * | 3/1970 | Schoffner | A41C 3/0014 450/70 |
| 3,537,279 | A | 11/1970 | Epley | |
| 3,561,234 | A | 2/1971 | Mishcon et al. | |
| 3,640,096 | A | 2/1972 | Betts et al. | |
| 3,668,896 | A | 6/1972 | Betts et al. | |
| 3,668,898 | A | 6/1972 | Betts et al. | |
| 3,677,252 | A | 7/1972 | Pedley | |
| 3,695,063 | A | 10/1972 | Betts et al. | |
| 3,789,098 | A | 1/1974 | Cole et al. | |
| 3,796,068 | A | 3/1974 | Betts et al. | |
| 3,985,003 | A | 10/1976 | Reed | |
| 4,019,350 | A | 4/1977 | Schmidt | |
| 4,100,766 | A | 7/1978 | Kuhnert | |
| 4,267,710 | A | 5/1981 | Imamichi | |
| 4,311,150 | A | 1/1982 | Schreiber et al. | |
| 4,356,710 | A | 11/1982 | Mizuno et al. | |
| 4,419,997 | A | 12/1983 | Cole et al. | |
| 5,120,264 | A | 6/1992 | Van Engel | |
| 5,214,941 | A | 6/1993 | Essig | |
| 5,359,865 | A | 11/1994 | So | |
| 5,787,503 | A | 8/1998 | Murphy, III | |
| 5,887,451 | A | 3/1999 | Suzuki | |
| 5,890,381 | A | 4/1999 | Leeke et al. | |
| 5,916,272 | A | 6/1999 | Nonnenmacher et al. | |
| 5,946,944 | A | 9/1999 | Osborne | |
| 5,956,765 | A | 9/1999 | Chin | |
| 6,089,052 | A | 7/2000 | Riegger | |
| 6,178,784 | B1 | 1/2001 | Marley | |
| 6,443,805 | B1 | 9/2002 | Kirkwood | |
| 6,526,783 | B2 | 3/2003 | Sheu | |
| 6,550,286 | B2 | 4/2003 | Querquant | |
| 6,645,040 | B2 | 11/2003 | Rabinowicz et al. | |
| 6,685,534 | B2 | 2/2004 | Mitchell et al. | |
| 6,779,367 | B2 | 8/2004 | Mitchell et al. | |
| 6,779,369 | B2 | 8/2004 | Shepherd | |
| 6,824,445 | B2 | 11/2004 | Oneyear et al. | |
| 6,899,591 | B2 | 5/2005 | Mitchell | |
| RE38,853 | E | 10/2005 | Rabinowicz | |
| 7,001,240 | B1 | 2/2006 | Huffman-Jimenez | |
| 7,043,329 | B2 | 5/2006 | Dias et al. | |
| 7,169,011 | B2 | 1/2007 | Mitchell et al. | |
| 7,442,110 | B2 | 10/2008 | Gaudet et al. | |
| 7,536,879 | B2 | 5/2009 | Vanwelden | |
| 7,611,999 | B2 | 11/2009 | McMurray | |
| 7,614,256 | B2 | 11/2009 | Mitchell | |
| 7,716,954 | B2 | 5/2010 | Naka et al. | |
| 8,128,457 | B2 | 3/2012 | Reinisch et al. | |
| 8,226,452 | B2 | 7/2012 | Hendrickson | |
| 8,398,453 | B2 | 3/2013 | Mitchell et al. | |
| 8,469,769 | B2 | 6/2013 | Hendrickson | |
| 8,550,872 | B2 | 10/2013 | Upton et al. | |
| 8,640,503 | B2 | 2/2014 | Kunde et al. | |
| 8,690,634 | B2 | 4/2014 | Heath et al. | |
| 9,375,045 | B2 | 6/2016 | Farris et al. | |
| 9,375,046 | B2 | 6/2016 | Meir | |
| 9,405,205 | B2 | 8/2016 | De Graaf et al. | |
| 9,538,794 | B2 | 1/2017 | Turlan | |
| 10,145,042 | B2 * | 12/2018 | Diaz | A41C 3/0057 |
| 10,179,960 | B2 * | 1/2019 | Diaz | A41C 3/0057 |
| 2004/0097151 | A1 | 5/2004 | McMurray | |
| 2004/0099016 | A1 | 5/2004 | Shepherd | |
| 2004/0168479 | A1 | 9/2004 | McMurray | |
| 2005/0115282 | A1 | 6/2005 | Starbuck | |
| 2006/0243000 | A1 | 11/2006 | Turlan et al. | |
| 2008/0268217 | A1 | 10/2008 | Kanatani et al. | |
| 2010/0184355 | A1 | 7/2010 | Kennedy | |
| 2014/0068968 | A1 | 3/2014 | Podhajny et al. | |
| 2014/0366585 | A1 | 12/2014 | Shen et al. | |

FOREIGN PATENT DOCUMENTS

| | | | |
|---|---|---|---|
| FR | 2852026 | A1 | 9/2004 |
| GB | 1574736 | A | 9/1980 |
| JP | 5361320 | B2 | 12/2013 |
| WO | 2005041702 | A2 | 5/2005 |
| WO | 2016197051 | A1 | 12/2006 |
| WO | 2011106014 | A1 | 9/2011 |

OTHER PUBLICATIONS

"Leading Lady Seamless Knit Nursing Bra," Hanes®, hanes.com, Style #24304, accessed Oct. 12, 2015 http://www.hanes.com/hanes/onehanesplace/bra/shop-by-category/nursing-bras/leading-lady-nursing-bra-24304, 4 pages.

"Simplicity Mother's Breast Feeding Maternity Nursing Bra Tank Top Camisole," Amazon, amazon.com, Accessed Oct. 2015; http://www.amazon.com/Simplicity%C2%AE-Womens-Maternity-Nursing-Sleeveless/dp/B00LQ108FK, 4 pages.

Stoll Performance Plus SS-2016-ES Brochure, © 2016 H. Stoll AG & Co., KG, Germany, 36 pages.

International Search Report and Written Opinion dated Feb. 3, 2017 in International Patent Application No. PCT/US2016/060261, 13 pages.

Non-Final Office Action dated Sep. 18, 2017 in U.S. Appl. No. 15/584,925, 7 pages.

"Breast sizing and development of 3D seamless bra"; Rong Zheng; 2007 http://ira.lib.polyu.edu.hk/handle/10397/2619, 322 pages.

"Three Dimensional Seamless Garment Knitting on VBedFlat Knitting Machines"; Wonseok Choi et al. https://www.researchgate.net/publication/237482349_Three_dimensional_seamless_garment_knitting_on_V-bed_flat_knitting_machines, 34 pages.

Notice of Allowance dated Feb. 5, 2018 in U.S. Appl. No. 15/584,925, 5 pages.

Final Office Action dated Oct. 18, 2018 in U.S. Appl. No. 15/341,788, 13 pages.

Notice of Allowance dated Apr. 24, 2018 in U.S. Appl. No. 15/584,925, 5 pages.

International Preliminary Report on Patentability dated May 17, 2018 in International Patent Application No. PCT/US2016/060261, 9 pages.

International Search Report and Written Opinion dated Feb. 8, 2018 in International Patent Application No. PCT/US2017/030859, 14 pages.

International Search Report and Written Opinion dated Feb. 8, 2018 in International Patent Application No. PCT/US2017/030861, 14 pages.

International Search Report and Written Opinion dated Feb. 9, 2018 in International Patent Application No. PCT/US2017/030863, 14 pages.

International Search Report and Written Opinion dated Feb. 8, 2018 in International Patent Application No. PCT/US2017/030947, 14 pages.

Non-Final Office Action dated Mar. 28, 2018 in U.S. Appl. No. 15/341,788, 13 pages.

Notice of Allowance dated Jul. 16, 2018 in U.S. Appl. No. 15/584,925, 5 pages.

Notice of Allowance dated Aug. 30, 2018 in U.S. Appl. No. 15/584,930, 6 pages.

Notice of Allowance dated Mar. 21, 2019 in U.S. Appl. No. 15/341,788, 17 pages.

* cited by examiner

UPPER-TORSO GARMENT WITH THREE-DIMENSIONAL KNIT STRUCTURES

TECHNICAL FIELD

This disclosure relates to an upper-torso garment, at least a portion of which includes a three-dimensional knit structure.

BACKGROUND

Upper-torso garments typically include various parts configured to cover an upper-torso region of a wearer. For example, upper-torso garments often include a chest-covering portion and a back-covering portion. In addition, upper-torso garments may include various textiles and material types, which are sometimes selected based on various properties. An example of one type of textile that may have various properties and that may be used to construct at least part of an upper-torso garment is a knit textile.

BRIEF DESCRIPTION OF THE DRAWINGS

The subject matter of this disclosure is described in detail herein with reference to the attached figures, which are incorporated herein by reference.

DETAILED DESCRIPTION

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the scope. It will be understood that certain features and subcombinations are of utility and may be employed without reference to other features and subcombinations. This is contemplated by and is within the scope of the claims.

At a high level, this disclosure describes an upper-torso garment having various elements that contribute to the operation of the article, both independently of, and in combination with, one another. In one aspect, the upper-torso garment includes three-dimensionally-knit (3D-knit) domed portions configured to cover different regions of a wearer's body. For example, the 3D-knit domed portions might be configured to cover a breast region, shoulder region, or other torso body part. The 3D-knit domed portions might include various knit structures, and in one instance, the 3D-knit domed portions include partial-knit rows. Other elements may also affect the properties of the garment, including (but not limited to) the yarn composition and size, additional knit structures, and stitch size, which will be described in more detail in other parts of this disclosure. Among other things, 3D-knit domed portions (including the partial-knit rows) are constructed of a tubular-jacquard knit structure. These and other aspects will be described in more detail with reference to the figures.

Figure 1:
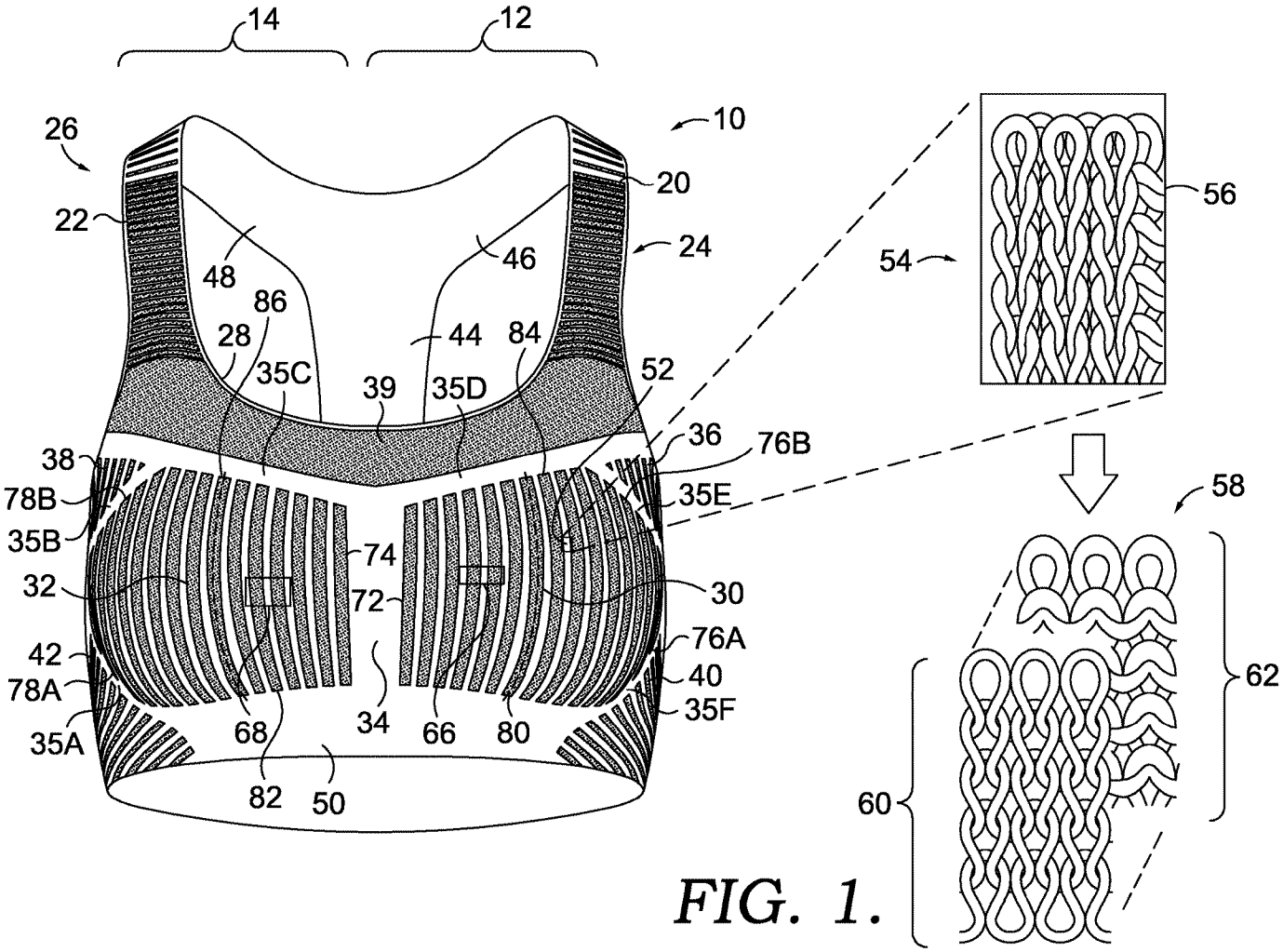
FIG. 1 depicts a front view of an upper-torso garment in accordance with an aspect of this disclosure.
Figure 3:
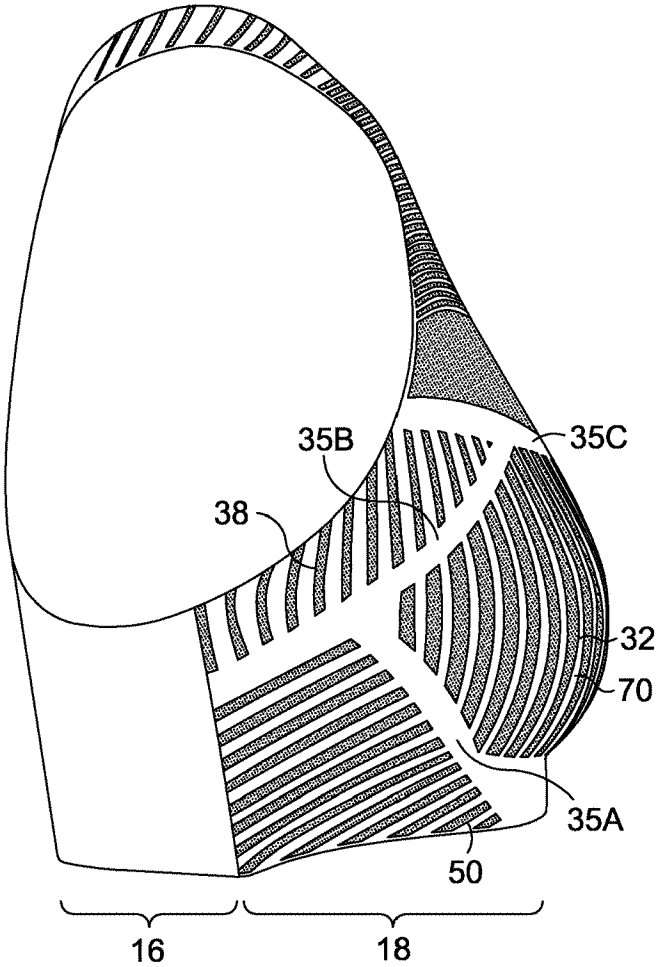
FIG. 3 depicts a side view of the garment depicted in FIG. 1.
Figure 2:
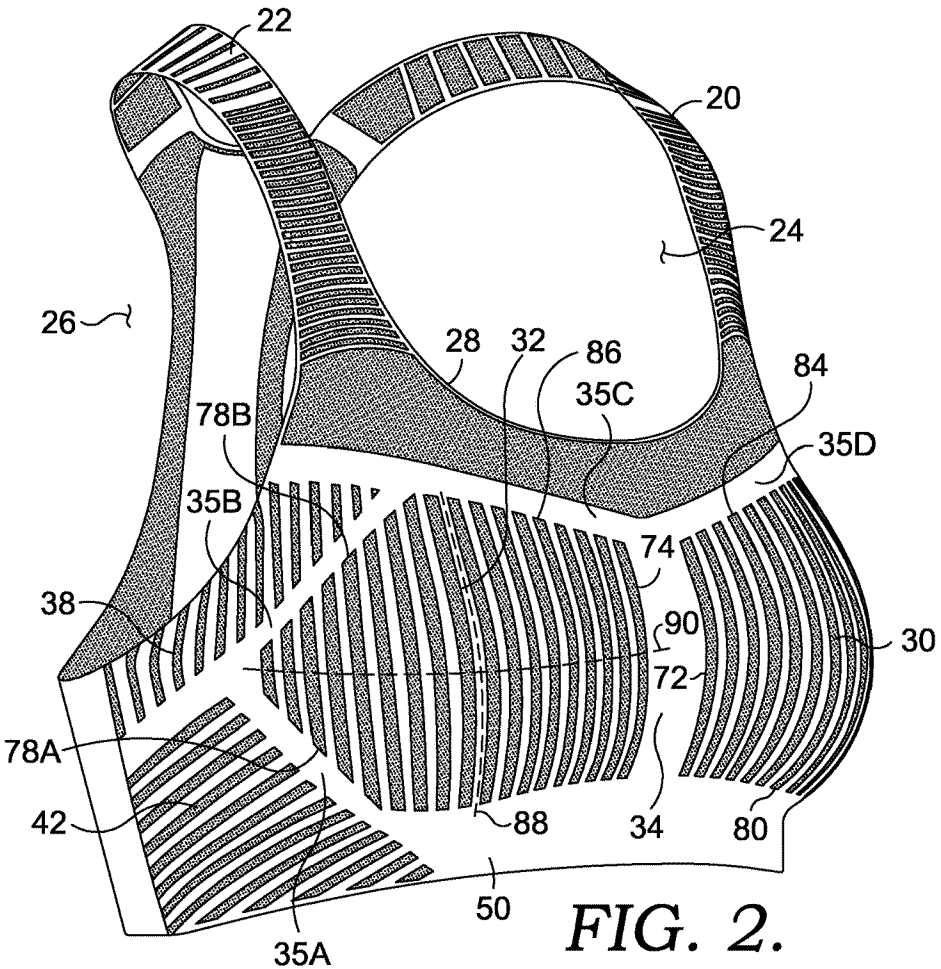
FIG. 2 depicts a front perspective view of the garment depicted in FIG. 1.

Referring initially to FIGS. 1-3, an exemplary upper-torso garment 10 is depicted, and in this description, "upper-torso garment" describes any garment configured to cover an upper-torso of a wearer. The illustrated upper-torso garment 10 is a bra, and the style of bra depicted is sometimes referred to as a sports bra, athletic bra, or other similar designation. And in other aspects of this disclosure, an upper-torso garment may include various other types of garments for a male or female, including a strapless bra, a camisole, a base-layer shirt, a singlet, a racing suit, and the like.

When describing various aspects of the upper-torso garment 10, relative terms may be used to aid in understanding relative positions. For instance, the upper-torso garment 10 may be divided into a left side 12 and a right side 14. In addition, the upper-torso garment 10 may include a posterior portion 16, which typically covers at least part of a wearer's back when the upper-torso garment 10 is in an in-use state, and an anterior portion 18 that typically covers at least part of a wearer's chest in the in-use state.

Furthermore, the upper-torso garment 10 includes various parts that may also be referred to when describing aspects of the disclosure. For instance, the upper-torso garment 10 includes shoulder straps 20 and 22, as well as arm holes 24 and 26 and a neckline 28, which generally forms a perimeter around a neck-receiving aperture. In addition, the upper-torso garment 10 includes a breast-covering portion 30 on the left side 12 and a breast-covering portion 32 on the right side 14, and a center bridge 34 is positioned between the breast-covering portions 30 and 32. The upper-torso garment 10 also includes a series of encapsulation regions 35A, 35B, 35C, 35D, 35E, and 35F that form a perimeter around at least a portion of the breast-covering portions 30 and 32.

Moreover, the upper-torso garment 10 includes an upper-chest portion 39, a left underarm portion 36, a right underarm portion 38, a left wing 40, and a right wing 42. The posterior portion 16 includes a racerback-style rear panel having a main trunk 44 with rear straps 46 and 48. The trunk 44 and the rear straps 46 and 48 generally form a "T" shape or a "Y" shape, and the straps 46 and 48 connect with the shoulder straps 20 and 22. A chest band 50 extends circumferentially beneath the breast-covering portions 30 and 32 and the wings 40 and 42 and wraps entirely around to the posterior portion 16. The chest band 50 is illustrated without any clasp or other releasable connector, which might be included in an alternative aspect. These relative regions and parts are not necessarily intended to demarcate precise areas of the upper-torso garment 10, and they are provided for explanatory and illustrative purposes. However, the upper-torso garment 10 may include structural elements, such as seams or transition zones, that provide logical divisions or demarcation.

The upper-torso garment 10 may include other parts, regions, and portions that are not necessarily denoted in FIGS. 1-3, such as a cradle region, underwire, and the like. In addition, as indicated above, the bra-style, upper-torso garment 10 depicted in FIGS. 1-3 is merely illustrative of type of upper-torso garment, and in other aspects of this disclosure, an upper-torso garment may have sleeves, an abdomen-covering portion, a lumbar-covering portion, integral shorts or pants (e.g., such as in a unitard with or without sleeves and with various leg lengths), and the like. Furthermore, in other aspects of the disclosure, an upper-torso garment may not include all of the parts and regions depicted in FIGS. 1-3. For example, an upper-torso garment might have different encapsulation regions (or no encapsulation regions), a different sized center bridge, a different posterior structure (such as crisscross, tank-style, and the like), etc.

In an aspect of this disclosure, the upper-torso garment 10 includes a knit-textile region, and as used in this disclosure, "knit-textile region" generally refers to at least a portion of the upper-torso garment 10 constructed of one or more yarn strands that are interlooped with one another. For instance, in FIG. 1 an exemplary knit-textile region 52 is identified, and additional details of the knit-textile region 52 are further depicted in a magnified view 54, which illustrates an exemplary knit structure 56. As depicted by the partially exploded view 58, the knit structure 56 includes courses of interlooped front stitches 60 and courses of interlooped back stitches 62.

The knit textile region 52 is identified in FIG. 1 for illustrative purposes to allow for the depiction and explanation of knit structures, and in other aspects of this disclosure, the upper-torso garment 10 includes one or more other knit-textile regions that are larger than the region 52 and/or are positioned in other regions and parts of the upper-torso garment 10. For example, at least some of the anterior portion of the upper-torso garment 10 may include or more knit structures, including the chest band 50, breast-covering portions 30 and 32, center bridge 34, encapsulating bands 35A-F underarm portions 36 and 38, wings 40 and 42, straps 20 and 22, and any combination thereof. These parts of the upper-torso garment 10 may be integrally knit as a continuous knit panel or may be separate knit panels that are coupled together to form the upper-torso garment.

In an aspect of the present disclosure, the breast-covering portions 30 and 32 each include a knit textile region 66 and 68. The breast-covering portions 30 and 32 include various features that may identify the breast-covering portions. For example, the breast-covering portions 30 and 32 are generally positioned superior to the chest band 50 and inferior to the straps 20 and 22. In addition, the breast-covering portions 30 and 32 are generally on the anterior side of the upper-torso garment 10, between the underarm portions 36 and 38 and between the wings 40 and 42. Furthermore, as suggested by FIGS. 1-3, the breast-covering portions 30 and 32 may be separated by a center bridge 34 and may be bordered on one or more sides by encapsulation regions 35A-F. And in some other aspects, the center bridge 34 may be omitted, such that the breast-covering portions 30 and 32 form a single breast-covering portion that spans the anterior side from left-side wings and underarm portions to the right-side wings and underarm portions. Likewise, the thickness of the encapsulation regions 35AS-F may be reduced, or the encapsulating regions may be omitted in other aspects of the disclosure.

As illustrated by the side views of FIG. 2 and FIG. 3, the breast-covering portions 30 and 32 include a convex exterior surface 70, and as such include a concave interior surface that is not viewable from the perspectives shown in FIGS. 1-3. The breast-covering portions 30 and 32 may cover and possibly contact a breast region of the wearer when the upper-torso garment 10 is in an in-use state, such as when donned by a human or mannequin. Furthermore, the breast-covering portions 30 and 32 may provide compressive support to respective breast tissue of a wearer. The size and shape of the breast-covering portions 30 and 32 depicted in FIGS. 1-3 is illustrative of one aspect of the subject matter described herein, and in other aspects, the size and shape may be varied.

The breast-covering portions 30 and 32 having the convex exterior surface 70 are dome shaped and may be constructed in various manners. For example, in one aspect of the present disclosure, the breast-covering, dome-shaped portions include a plurality of partial-length courses, which add material (i.e., knit stitches) to different locations throughout the breast-covering portions to build up the knit-textile region and create the dome shape.

With continued reference to FIGS. 1-3, each of the breast-covering portions 30 and 32 extends from a medial perimeter edge 72 and 74 to a lateral perimeter edge 76A/B and 78A/B and from an inferior perimeter edge 80 and 82 to a superior perimeter edge 84 and 86. As depicted in FIGS. 1-3, the medial perimeter edges 72 and 74 are directly adjacent to the center bridge 34, and the lateral perimeter edges are bordered by encapsulation regions 35A, 35B, 35E, and 35F. In addition, the inferior perimeter edge 80 and 82 is bordered by the chest band 50, and the superior perimeter edges are bordered by, and directly adjacent to, encapsulation regions. Furthermore, each breast-covering portion 30 and 32 includes a longitudinal midline 88 (see e.g., FIG. 2) that evenly divides the breast-covering portion into a left side and a right side. Each breast-covering portion 30 and 32 also includes a latitudinal midline 90 (see e.g., FIG. 2) that evenly divides the breast-covering portion into a top half and a bottom half.

The knit textile panels that construct the breast-covering portions include a plurality of knit courses that span the dome-shaped portions from the center bridge to the lateral perimeter edge. Furthermore, in accordance with an aspect of the present disclosure, the knit textile panels also include a plurality of partial-length courses that are shorter than the plurality of knit courses and that are intermittently positioned among the plurality of knit courses. The partial-length courses add material in the form of knit stitches in order to construct the 3D-knit dome structures. In other words, if the portions of the upper-torso garment that border the breast-covering portions are arranged in an X-Y plane, then the partial-length courses build the dome-shaped portions in the Z direction. In an aspect of the present disclosure, the partial-length courses are unevenly distributed within the breast-covering portions. That is, the partial-length courses are unevenly distributed between the top half and the bottom half, between the right side and the left side, or any combination thereof.

Referring now to FIGS. 4-7, each figure depicts a portion of an upper-torso garment in which some details have been removed or simplified, and each figure illustrates how partial-length courses might be distributed and positioned in breast-covering portions 30 and 32, in accordance with some aspects of this disclosure. Each upper-torso garment is depicted flat (as compared with the depictions in FIGS. 1-3), and it is understood that when an upper-torso garment is constructed consistent with FIGS. 4-7, then the breast-covering portions will not be flat (as depicted in FIGS. 4-7), and instead will include 3D-knit, dome-shaped portions.

In each upper-torso garment of FIGS. 4-7, the breast-covering portions 30 and 32 include a medial perimeter edge 72 and 74, a lateral perimeter edge 76A/B and 78A/B, an inferior perimeter edge 80 and 82, and a superior perimeter edge 84 and 86. As previously described, the medial perimeter edges 72 and 74 are directly adjacent to the center bridge 34, and the lateral perimeter edges are bordered by encapsulation regions 35A, 35B, 35E, and 35F. In addition, the inferior perimeter edge 80 and 82 is bordered by the chest band 50, and the superior perimeter edges 84 and 86 are bordered by, and directly adjacent to, encapsulation regions 35D and 35C. Furthermore, as previously described, each breast-covering portion 30 and 32 includes a longitudinal midline 88A and 88B that evenly divides the breast-covering portion into a medial portion side and a lateral portion. Each breast-covering portion 30 and 32 also includes a latitudinal midline 90A and 90B that evenly divides the breast-covering portion into a top half and a bottom half.

In each of the FIGS. 4-7, each breast-covering portion 30 and 32 is constructed of a knit textile panel, which includes a plurality of courses fully spanning the breast-covering portions 30 and 32 from the medial perimeter edge 72 and 74 to the lateral perimeter edge 76A/B and 78A/B. For illustrative purposes the plurality of courses that fully span the breast-covering portions 30 and 32 are depicted by a stipple-shaded zone 91A-C, and although the courses that span the breast-covering portions 30 and 32 are not depicted beyond the perimeter edges, it is understood that the courses might extend into other portions of the upper-torso garment (e.g., into the encapsulation regions, wings, underarm portions, etc.). Many of the elements included in each of the breast-covering portions 30 and 32 are mirror-images of one another, and as such, it is understood that in some instances, a description of a feature in one of the breast-covering portions also applies to the other breast-covering portion.

Figure 4:
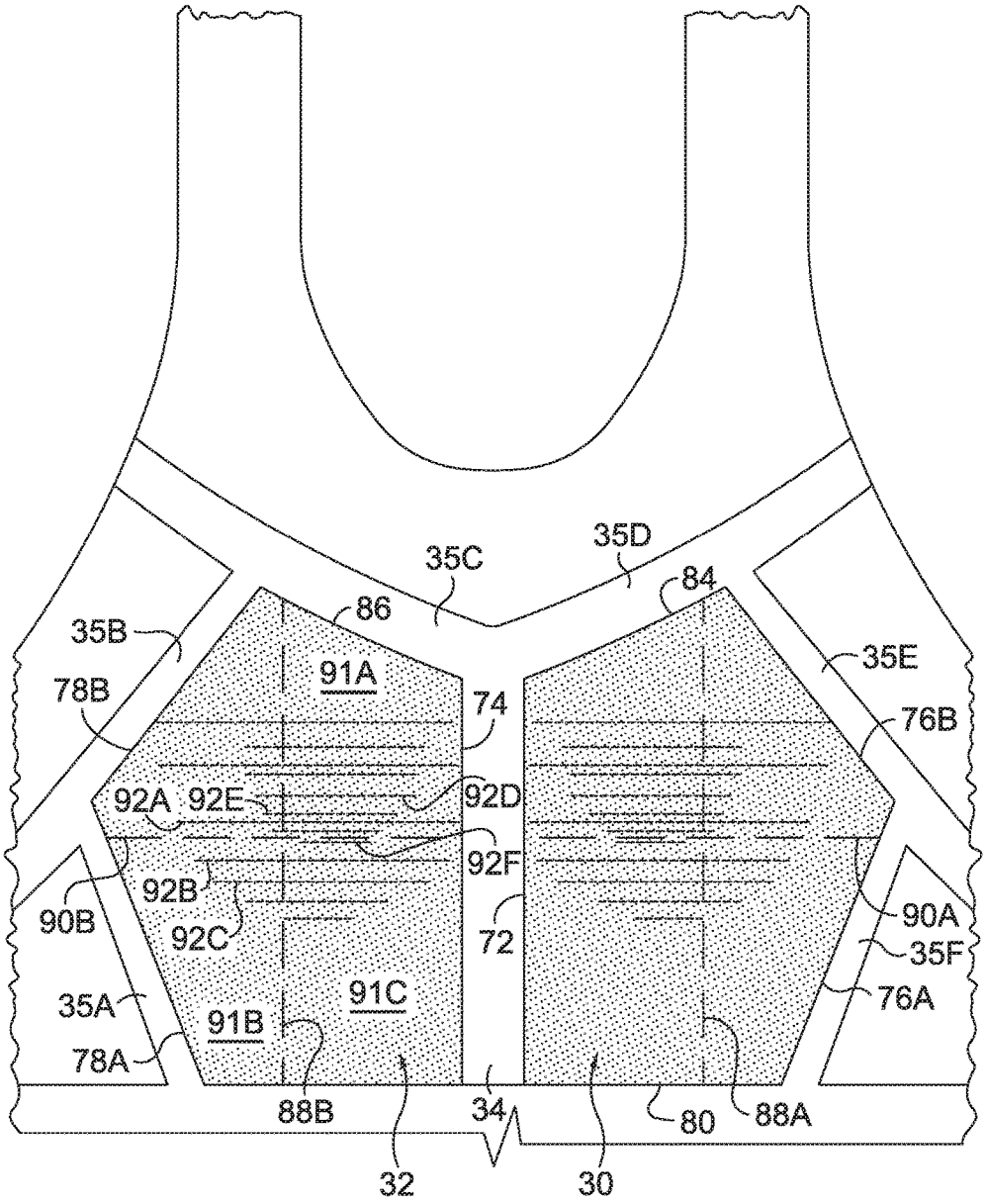
FIG. 4 depicts a schematic of a front portion of an upper-torso garment and illustrates an exemplary location of partial-knit courses in accordance with an aspect of this disclosure.

In addition, each of FIGS. 4-7 illustrates a different arrangement of partial-length courses, each of which will yield a dome-shaped portion having a different 3D geometry based on a location of the partial-length courses in the breast-covering portions 30 and 32. For example, FIG. 4 depicts a plurality of partial-length courses 92A-F that partially span the breast-covering portion 32. The partial-length courses 92A-F are intermittently positioned among the plurality of courses 91A-C. In addition, a larger quantity of partial-length courses are distributed in the top half, as compared with the bottom half, which may increase the volume of the dome-shaped portion in the top half of the breast-covering portion 32. Moreover, a larger portion of the partial-length courses are distributed in the medial portion of the breast-covering portion 32.

Furthermore, the partial-length courses 92A-F include a first partial-length course 92A having a first length, a second partial length course 92B having a second length that is shorter than the first length, and a third partial-length course 92C having a third length that is shorter than the second length. Because the second course 92B is positioned between the first course 92A and the third course 92C, the courses 92A-92C gradually taper in size (from largest to smallest), and the resulting dome-shaped portion may include a more rounded inferior edge.

The breast-covering portion 32 may include multiple subsets of partial-length courses that taper in length from longest to shortest. For example, the courses 92A-9C represent a first subset of courses that taper in length (as described above). In addition, the breast-covering portion 32 includes another subset of partial-length courses 92D-F that also taper in length from a longest to shortest. In accordance with an aspect of this disclosure, the subset of courses 92D-F at least partially overlap with the first subset of courses 92A-C. In other words at least one of the courses from 92D-F is positioned between at least two of the courses included in the first subset 92A-C. The at least partially overlapping subsets of partial-length courses help to build the breast-covering portion in the Z direction in a gradual manner that yield a convexly shaped outer surface.

Figure 5:
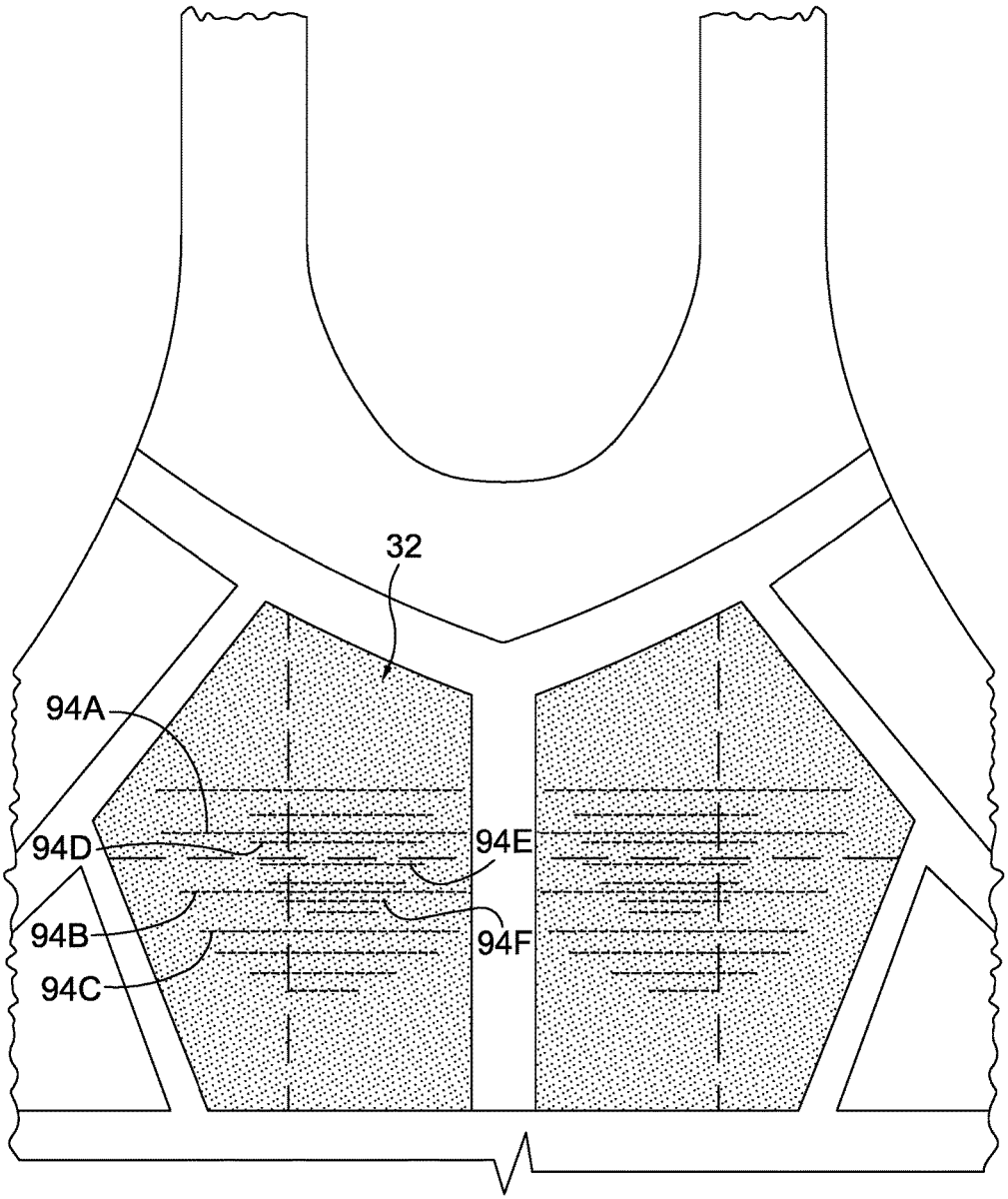
FIG. 5 depicts a schematic of a front portion of another upper-torso garment and illustrates an exemplary location of partial-knit courses in accordance with an alternative aspect of this disclosure.

Referring now to FIG. 5, another upper-torso garment is depicted with a plurality of partial-length courses 94A-F that partially span the breast-covering portion 32. The partial-length courses 94A-F are intermittently positioned among the plurality of courses (depicted by stipple-shaded portion). In addition, a larger quantity of partial-length courses are distributed in the bottom half, as compared with the top half, which may increase the volume of the dome-shaped portion in the bottom half of the breast-covering portion 32. In addition, similar to FIG. 4, the partial-length courses 94A-F include subsets of courses that overlap with one another.

Figure 6:
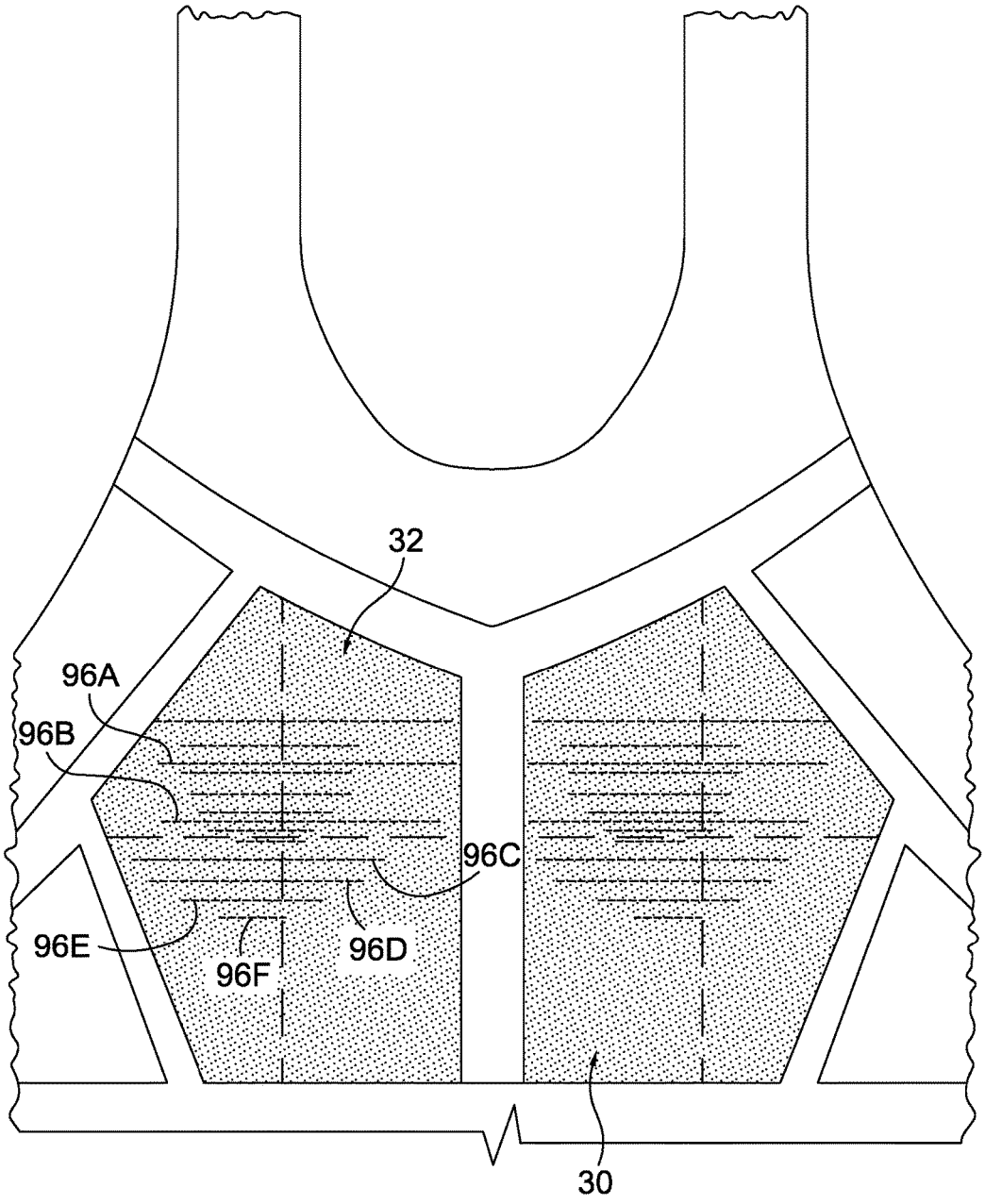
FIG. 6 depicts a schematic of a front portion of another upper-torso garment and illustrates an exemplary location of partial-knit courses in accordance with another aspect of this disclosure.

Referring now to FIG. 6, another upper-torso garment is depicted with a plurality of partial-length courses 96A-F that partially span the breast-covering portion 32. The partial-length courses 96A-F are intermittently positioned among the plurality of courses (depicted by stipple-shaded portion). In addition, a larger portion of the partial-length courses are distributed in the lateral portion of the breast-covering portion, as compared with the medial portion, which may increase the volume of the dome-shaped portion in the lateral portion.

Figure 7:
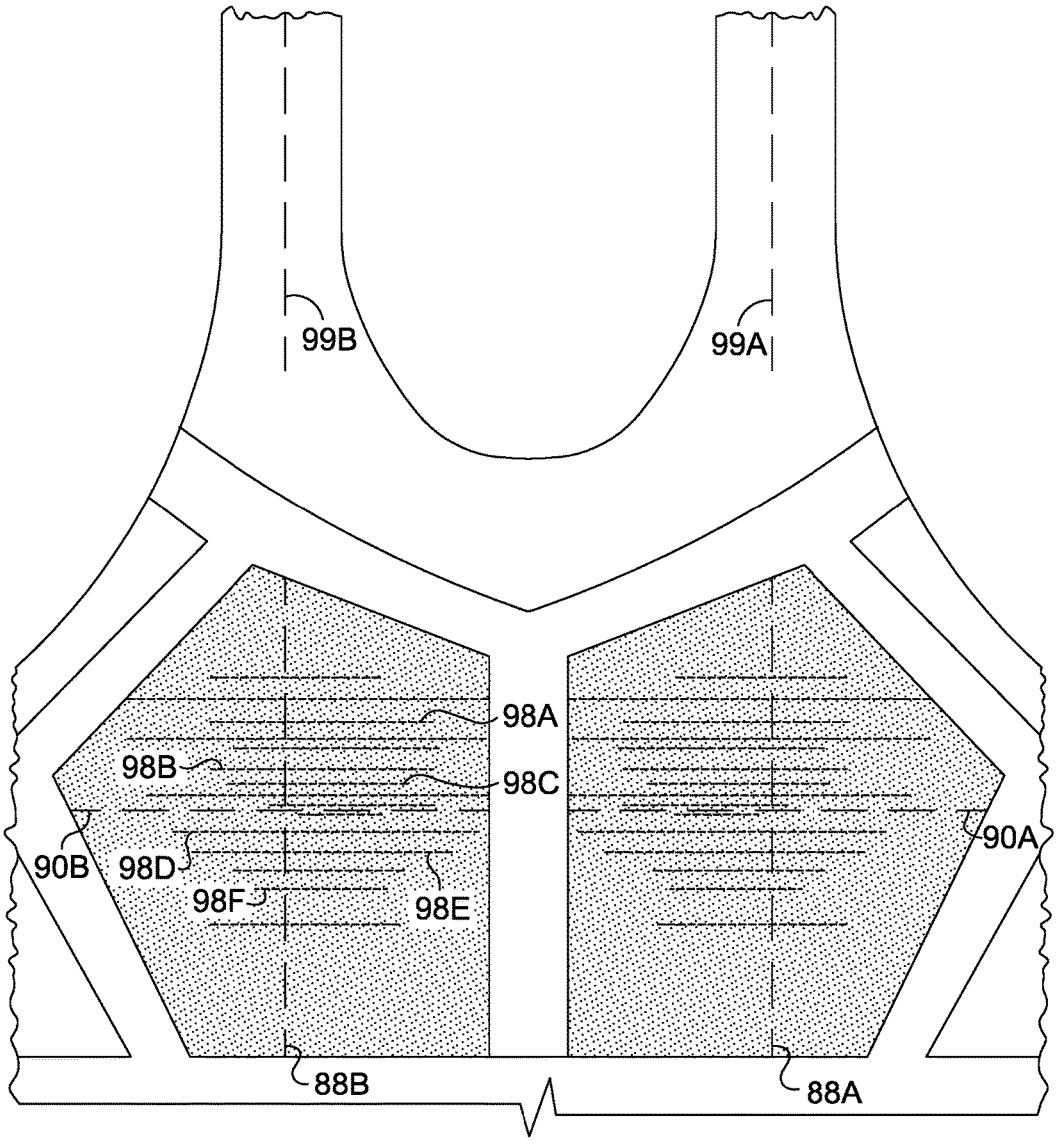
FIG. 7 depicts a schematic of a front portion of another upper-torso garment and illustrates an exemplary location of partial-knit courses in accordance with another aspect of this disclosure.

Referring now to FIG. 7, another upper-torso garment is depicted with a plurality of partial-length courses 98A-F that partially span the breast-covering portion 32. The partial-length courses 98A-F are intermittently positioned among the plurality of courses (depicted by stipple-shaded portion). In addition, a larger portion of the partial-length courses are distributed in the top half of the breast-covering portion, as compared with the bottom half, which may increase the volume of the dome-shaped portion in the top half.

In FIG. 7, the breast-covering portions are wider than in FIGS. 4-6, and as such, in an aspect of this disclosure, the larger distribution of partial-length courses in the top half might be used to construct a larger-sized upper-torso garment. For example, in an aspect of the present disclosure, an upper-torso garment having a size larger than 32C may include a larger distribution of partial-length courses in the top half of the breast-covering portion. Moreover, in FIG. 7, the shoulder straps each include a midline reference plane 99A and 99B that bisects a respective shoulder strap. In an aspect of the present invention, the midline reference plane intersects the plurality of partial-length courses 98A-F. By aligning the midline reference plane with the partial-length courses, the shoulder straps are aligned with the breast tissue enclosed knit textile panel. In a further aspect, the midline reference plane is aligned with an intersection of the longitudinal midline 88A and 88B and the latitudinal midline 90A and 90B.

The knit textile panel that constructs the breast-covering portions 30 and 32 may include various types of knit structures, and in one aspect of this disclosure, the knit textile regions 66 and 68 include a tubular-jacquard knit structure. That is, both the partial-length courses and the full length courses may include a tubular-jacquard knit structure, and for exemplary purposes, various tubular-jacquard knit structures are described with respect to FIGS. 8-16. For example, the tubular-jacquard knit structures in FIGS. 8-16 (as well as the corresponding description) disclose tubular-jacquard knit structures having various densities of interlocking cross overs (e.g., transfers of yarn strands), as well as tubular-jacquard knit structures with an interlocking tuck binder. Each of these knit structures might construct the full-length and partial-length courses described with respect to FIGS. 4-7 in order to form the dome-shaped, breast-covering portions. In addition, other knit structures that may not have the same elongation mechanics as the tubular-jacquard knit structure might also construct the full-length and partial-length courses, including (but not limited to) a double-jersey knit or single knit (e.g., jersey, rib, interlock, etc.).

Figure 8:
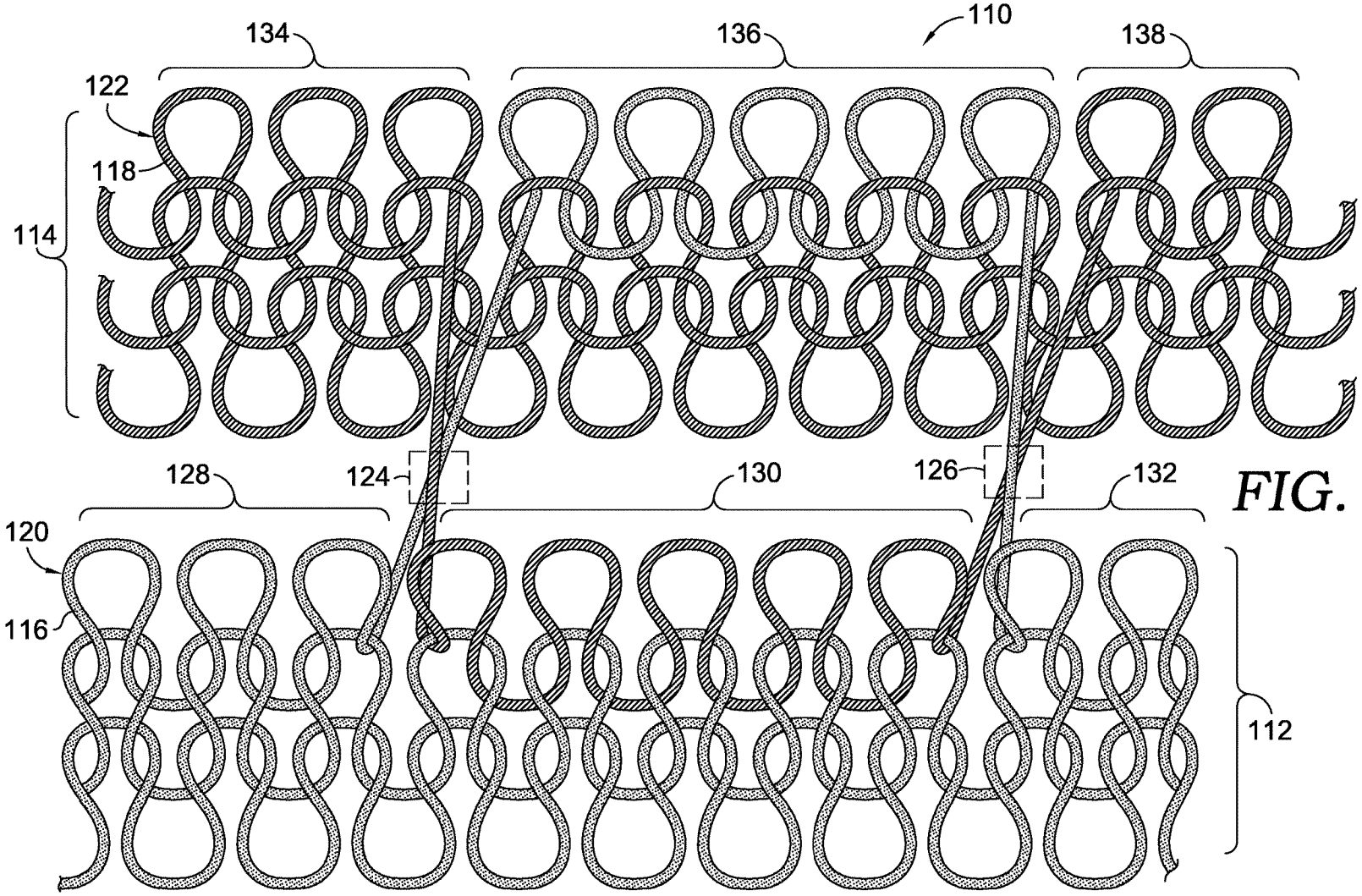
FIG. 8 depicts an exemplary knit schematic in accordance with an aspect of this disclosure.

Referring to FIG. 8 a schematic is depicted that illustrates some features of an exemplary tubular-jacquard knit structure 110. The tubular-jacquard knit structure 110 includes a plurality of front-stitch courses 112 and a plurality of back-stitch courses 114, which are constructed of a first yarn strand 116 and a second yarn strand 118. Furthermore, FIG. 8 depicts that one of the front-stitch courses 120 intermittently interlocks with one of the back-stitch courses 122 by way of the first yarn strand 116 extending from the front-stitch course 120 to the back-stitch course 122. In addition, at a location corresponding with the first yarn strand 116 extending to the back-stitch course 122, the second yarn strand 118 extends from the back-stitch course 122 to the front-stitch course 120.

In accordance with an aspect of this disclosure, this structure in which the first yarn strand 116 extends from the front-stitch course 120 to the back-stitch course 122 and the second yarn strand 118 extends from the back-stitch course 122 to the front-stitch course 120 is referred to as an "interlocking cross over," which is identified by reference numeral 124. In FIG. 8, another interlocking cross over 126 is illustrated in which the first yarn strand 116 extends from the back-stitch course 122 to the front-stitch course 120, and the second yarn strand 118 extends from the front-stitch course 120 to the back-stitch course 122.

In accordance with an aspect of this disclosure, interlocking cross overs separate a front-stitch course into subsets of, or sub-quantities of, front stitches. For example, the interlocking cross overs 124 and 126 divide the front-stitch course 120 into a first quantity of front stitches 128, a second quantity of front stitches 130, and a third quantity of front stitches 132. Likewise, the back-stitch course 122 is divided into a first quantity of back stitches 134, a second quantity of back stitches 136, and a third quantity of back stitches 138.

In FIG. 8, the first yarn strand 116 is depicted having a different appearance than the second yarn strand 118. For example, the first yarn strand 116 may be a different color than the second yarn strand 118. In an aspect of this disclosure, the difference in appearance between the two yarn strands 116 and 118 results in a striping pattern when the first and second yarn strands intermittently switch back and forth between the front course and the back course, such as the illustrative striping patterns in FIGS. 1-3 in the breast-covering portions 30 and 32, underarm portions 36 and 38, and wings 40 and 42. The upper-torso garment 10 in FIGS. 1-3 is merely exemplary of one striping pattern that might be achieved, and in other aspects, an upper-torso garment might have a different pattern. In addition, the first yarn strand and the second yarn strand might have the same or similar appearance, such that a visual striping pattern is not created by the switching back and forth of the first yarn strand and the second yarn strand between the front and back courses.

Figure 9:
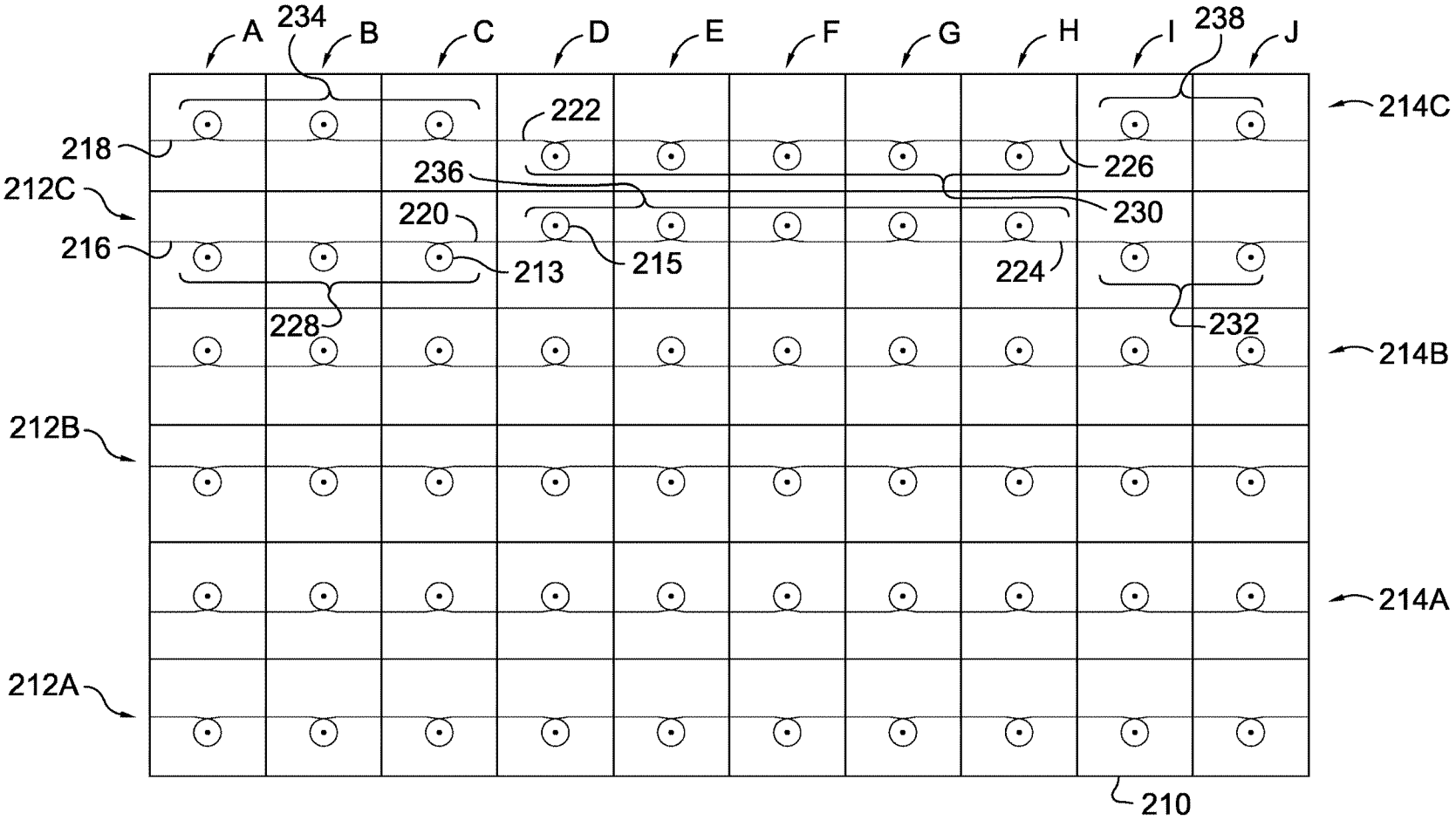
FIG. 9 depicts knit-program notations corresponding with the knit schematic in FIG. 8.

Referring now to FIG. 9, an exemplary knit diagram 210 is depicted corresponding with the tubular-jacquard knit structure 110 of FIG. 8. The knit diagram 210 includes a plurality of columns and rows. Each column represents a needle position and each row represents a yarn strand. The rows alternate between a first yarn strand and a second yarn stand, which are used to form the tubular-jacquard knit. Within each row, the stitch type is designated, together with an indication of whether the stitch is on the front bed or the back bed. A stitch notation beneath the "yarn" is on the front bed, and a stitch notation above the "yarn" is on the back bed. For example, a row 212C designates stitch type and stitch location for a first yarn strand 216 at ten needle positions A-J. The stitch notation 213 designates a stitch on the front bed, and the stitch notation 215 designates a stitch on the back bed. As such, the line segment 220 would correspond with the transfer from the front bed to the back bed.

Continuing with FIG. 9, each of the rows 212A-C prescribes knit structures for the first yarn strand 216, and the alternating rows 214A-C prescribe knit structures for a second yarn strand 218. The rows 212A and 212B prescribe ten stitches with the first yarn strand 216 on the front side of the knit structure, and the rows 214A and 214B prescribe ten stitches with the second yarn strand 218 on the back side of the knit structure. These rows 212A, 212B, 214A and 214B correspond with the first two front-stitch courses and the first two back-stitch courses in FIG. 8.

As previously described, row 212C designates stitches for the first yarn strand 216, which corresponds with the first yarn strand 116 of FIG. 8. As such, the row 212C sequentially designates three stitches on the front side, a transfer to the back side (i.e., line segment 220), five stitches on the back side, a transfer to the front side (i.e., line segment 224), and two stitches on the front side. Row 214C designates stitches for the second yarn strand 218, which corresponds with the second yarn strand 118 of FIG. 8, and as such, the row 214C sequentially designates three stitches on the back side, a transfer to the front side (i.e., line segment 222), five stitches on the front side, a transfer to the back side (i.e., line segment 226), and two stitches on the back side. When executed, the transfers designated by 220 and 222 translate into the interlocking cross over 124, and the transfers designated by 224 and 226 translate into the interlocking cross over 126. Accordingly, the combination of the stitches prescribed by the rows 212C and 214C translate to the front-stitch course 120 of FIG. 8 and the back-stitch course 122 of FIG. 8.

As described with respect to FIG. 8, interlocking cross overs separate a course into subsets of stitches. For example, in FIG. 9 the transfers 220, 222, 224, and 226 separate the interlocked course into a first quantity of front stitches 228, a second quantity of front stitches 230, a third quantity of front stitches 232, a first quantity of back stitches 234, a second quantity of back stitches 236, and a third quantity of back stitches 238.

Figure 10A:
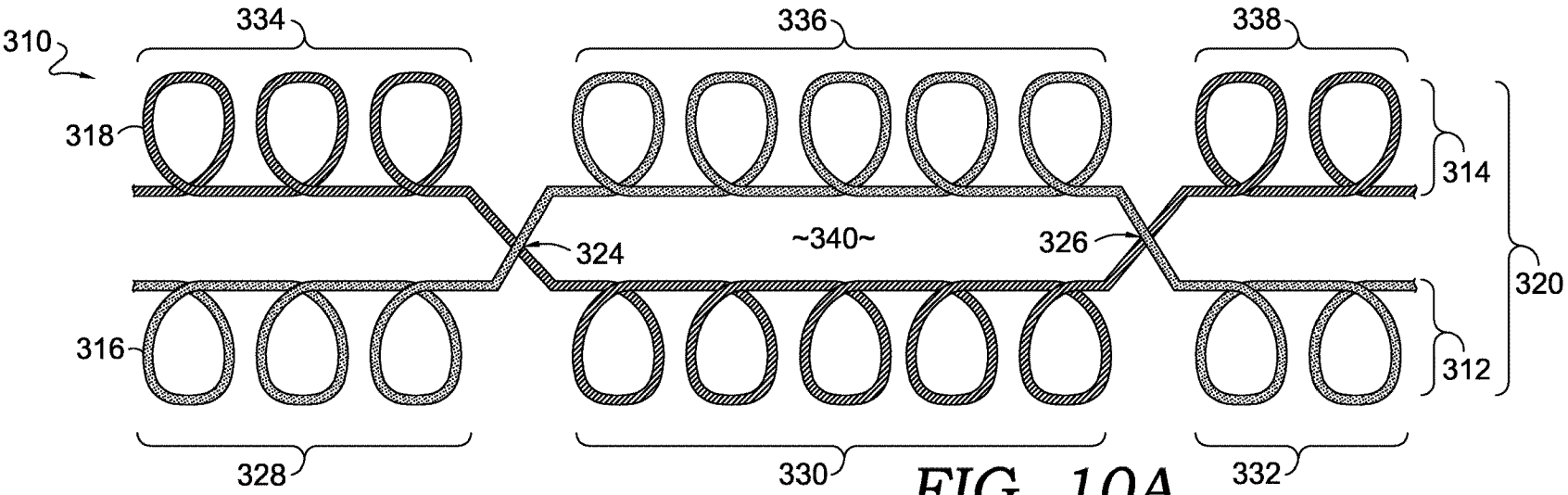
FIGS. 10A and 10B depict knit schematics illustrating interlocking cross overs of a front course and a back course in accordance with an aspect of this disclosure.

To further illustrate an exemplary tubular-jacquard knit structure 310, FIG. 10A includes another schematic of a front-stitch course 312 and a back-stitch course 314, which provide an alternative visual representation of the front-stitch course 120 and the back-stitch course 122 depicted in FIG. 8. The front-stitch course 312 and the back-stitch course 314 are formed of a first yarn strand 316 and a second yarn strand 318, and the front-stitch course 312 is intermittently interlocked with the back-stitch course 314 to form an interlocked course 320. The interlocked course 320 includes an interlocking cross over 324 of the yarn strands 316 and 318 that corresponds with the interlocking cross 124 (FIG. 8) and another interlocking cross over 326 that corresponds with the interlocking cross over 126 (FIG. 8).

Furthermore, FIG. 10A illustratively depicts that the interlocking cross overs 324 and 326 divide the interlocked course into a first quantity of front stitches 328, a second quantity of front stitches 330, a third quantity of front stitches 332, a first quantity of back stitches 334, a second quantity of back stitches 336, and a third quantity of back stitches 338. Within the interlocked course 320, the combination of the interlocking cross overs 324 and 326, the second quantity of front stitches 330, and the second quantity of back stitches 336 substantially partition off a space 340 between the two courses 312 and 314.

Figure 10B:
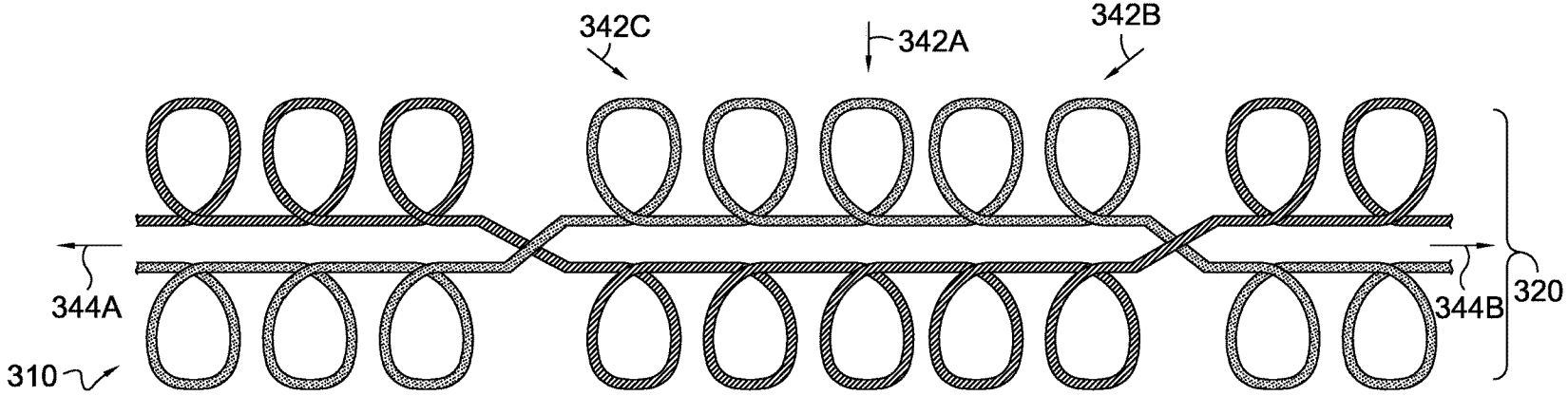

Referring to FIG. 10B, the knit structure 310 operates in various manners when subjected to a force. For example, when a force is applied in a direction (e.g., 342A, 342B, or 342C) that intersects the interlocked course 320, the knit structure 310 elongates in a direction (e.g., 344A and 344B) aligned with the interlocked course 320. In addition, when the force is removed, the knit structure 310 returns to its resting state. In one aspect of the disclosure, the interlocking cross overs 324 and 326 contribute to this property of the knit structure 310 by way of the first yarn strand 316 and the second yarn strand 318 mechanically altering from a first state (e.g., FIG. 10A) that is more bent or curved to a second state (e.g., FIG. 10B) that is straighter. In this sense, interlocking cross overs 324 and 326 function similar to expansion joints between the subsets of stitches.

When a knit textile region having the knit structure 310 is constructed into the upper-torso garment 10, a force might be applied to the knit structure in various contexts. For example, a force might be applied in a direction that intersects the interlocked course 320 when the upper-torso garment is donned and a portion of the wearer (e.g., breast tissue) presses against the knit textile region. As such, the knit textile region mechanically stretches or elongates to fit the wearer and provides a compressive force against the wearer.

In an aspect of the present disclosure, a density of interlocking cross overs (e.g., number of interlocking cross overs in a given knit region) included among a knit textile region is selected to achieve an amount of mechanical stretch and elongation and compressive force against a wearer's tissue (e.g., breast tissue). That is, a first interlocked course that includes more interlocking cross overs among a given number of stitches may elongate more than a second interlocked course with a fewer number of interlocking cross overs in the given number of stitches when the first and second interlocked courses are subjected to the same force. As such, the second interlocked course may provide more compression than the first interlocked course under the same conditions (e.g., garment size and wearer dimensions), and the first interlocked course will mechanically elongate more than the second interlocked course. Applying these principles, an aspect of the present disclosure includes an upper-torso garment including one or more tubular-jacquard knit structures, which provide a respective amount of elongation based at least in part on the density of interlocking cross overs.

Figure 11A:
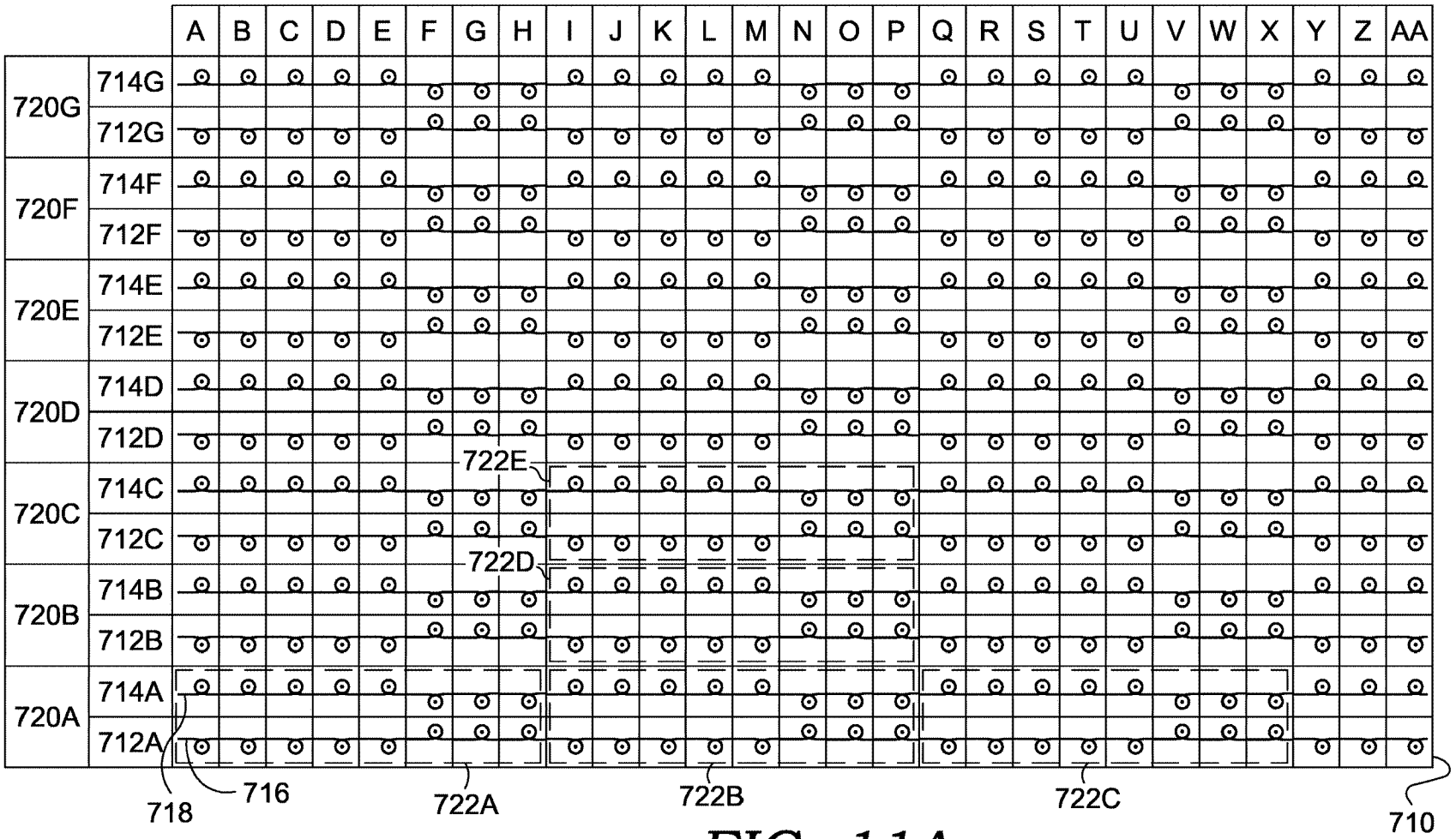
FIG. 11A depicts knit-program notations in accordance with an aspect of this disclosure.
Figure 11B:
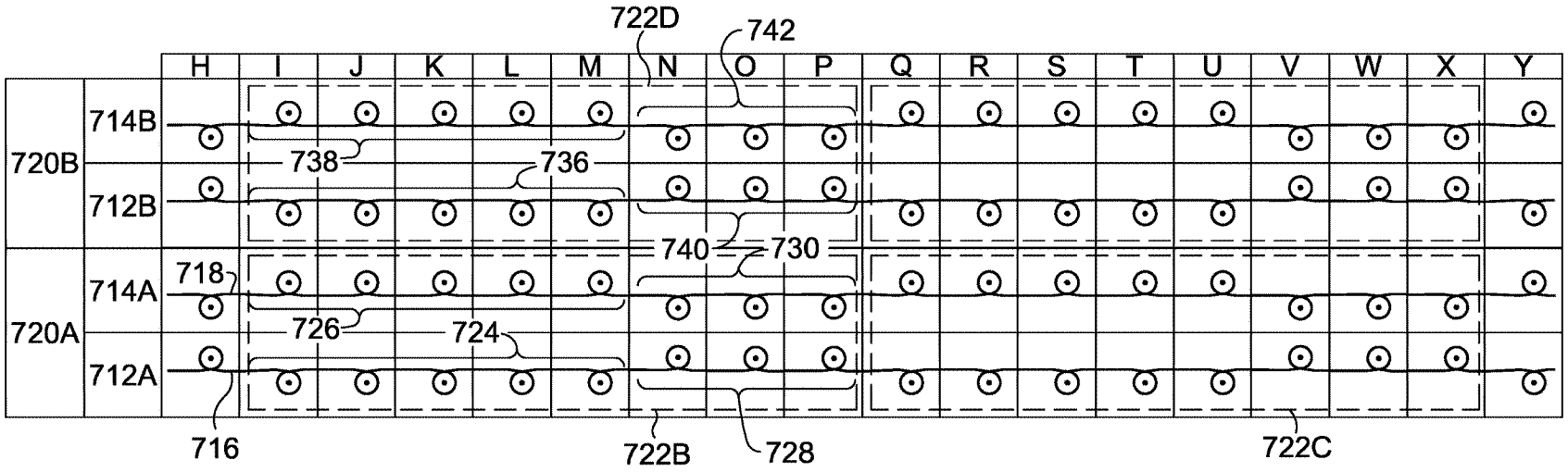
FIG. 11B depicts a magnified view of a portion of the schematic of FIG. 11A.

Referring to FIG. 11A a knit diagram 710 depicts a plurality of first-strand rows 712A-G that represent stitches formed with a first yarn strand 716 and a plurality of second-strand rows 714A-G that prescribe stitches formed with a second yarn strand 718. In addition, the knit diagram 710 includes a plurality of consecutively arranged needle positions (A-AA). When executed, a corresponding first-strand row (e.g., 712A) and a corresponding second-strand row (e.g., 714A) translate into a front-stitch course and back-stitch course, which include a density of interlocking cross overs. FIG. 11B includes a magnified view of a portion of the knit diagram 710, including the first-yarn rows 712A-B, the second-yarn rows 714A-B, and the subset of needle positions H-Y.

The first-strand stitches designated in the first-strand row 712A intermittently interlock with the second-strand stitches designated in the second-strand row 714A to form an interlocked course 720A. In addition, the interlocked course 720A includes an intra-course knit sequence that repeats along the interlocked course 720A. The intra-course knit sequence that repeats is outlined by a box 722A (FIG. 7A), and the repeating instances of the intra-course knit sequence are outlined by boxes 722B and 722C. FIG. 7B also illustrates the repeating intra-course knit sequences outlined by the boxes 722B and 722C. In accordance with an aspect of the disclosure, the structure of the intra-course knit sequence, as well as the repeating instances, contribute to the density of interlocking cross overs within the interlocked course.

Referring to FIG. 11B, the intra-course knit sequence (identified by the box 722B) includes a first quantity of front stitches 724 formed by the first yarn strand 716 and a first quantity of back stitches 726 formed by the second yarn strand 718. Furthermore, between the needle positions M and N, the first yarn strand 716 transfers from the front bed to the back bed, and the second yarn strand 718 transfers from the back bed to the front bed. The first yarn strand 716 then forms a second quantity of back stitches 728, and the second yarn strand 718 forms a second quantity of front stitches 730. The first yarn strand 716 and the second yarn strand 718 then cross back over after the second quantity of front stitches 730 and the second quantity of back stitches 728 and between the needle positions P and Q. The intra-course knit sequence then repeats at least once in the interlocked course after the crossing back over between the needle positions P and Q.

In the exemplary knit diagram, the quantity of front stitches in the intra-course knit sequence is eight (e.g., front stitches provided from needles I to P), and the quantity of back stitches in the intra-course knit sequence is eight. In addition, there is a single interlocking cross over among those eight front stitches and eight back stitches, prior to a second interlocking cross over initiating the repeating instance of the intra-course knit sequence. The intra-course knit sequence depicted in FIGS. 7A and 7B is merely exemplary of one aspect of the present disclosure, in which a knit textile region formed according to the structure prescribed by the knit diagram 710 includes an amount of elongation and compression properties resulting at least in part from the repeating pattern of eight front stitches, eight back stitches, and an interlocking cross over among the eight front and back stitches. And in other aspects of the disclosure, each respective intra-course knit sequence includes a quantity of front stitches equal to or greater than 4 and less than or equal to 12 and a quantity of back stitches equal to or greater than 4 and less than or equal to 12. The quantity of front stitches and back stitches in a repeating sequence may be selected and tuned based at least in part on an amount of compression to be provided by a knit textile region that will include the repeating sequence.

In FIGS. 11A and 11B, the knit program 710 depicts notations for a plurality of interlocked courses 720A, 720B, and 720C, and each interlocked course includes its own respective intra-course knit sequence (e.g., 722A, 722D, and 722E) that repeats along the respective interlocked course. In accordance with an aspect of the present disclosure, the first quantity of front stitches, the first quantity of back stitches, the second quantity of front stitches, and the second quantity of back stitches are all consistent among each of the respective intra-course knit sequences. For example, the interlocked course 720A includes an intra-course knit sequence 722A having five front stitches in a first quantity of front stitches 724, five back stitches in a first quantity of back stitches 726, three front stitches in a second quantity of front stitches 730, and three back stitches in a second quantity of back stitches 728. In a consistent manner, another interlocked course 720B includes an intra-course knit sequence (identified by box 722D) having five front stitches in a first quantity of front stitches 736, five back stitches in a first quantity of back stitches 738, three front stitches in a second quantity of front stitches 740, and three back stitches in a second quantity of back stitches 742.

In knit structures in which the respective intra-course knit sequences (e.g., the sequence in box 722A and the sequence in the box 722D), each of which is positioned in a respective interlocked course, include an equivalent number of stitches in each of the front and back stitch subsets, various arrangements may be implemented. For example, in FIGS. 11A and 11B, the interlocking cross overs of the interlocked courses 720A and 720B are positioned between the same pairs of needle positions M and N in adjacent interlooped courses. In addition, in all of the intra-course knit sequences 722A, 722D, and 722E the total number of front stitches and the total number of back stitches in a given intra-course knit sequence (i.e., eight front stitches and eight back stitches) are divided to create subsets having different quantities of stitches in the subsets (i.e., five stitches in one of the front-stitch subsets and three front-stitches in the other front-stitch subset).

Figure 12A:
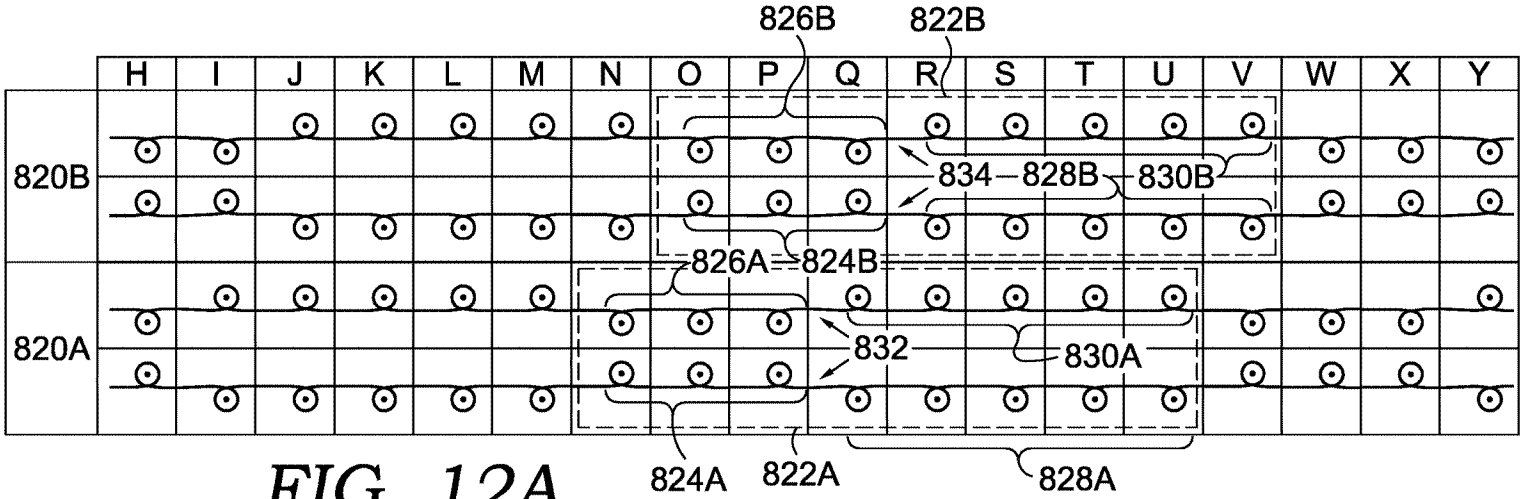
FIGS. 12A-12D each depicts additional knit schematics showing alternative knit structures in accordance with other aspects of this disclosure.

Referring now to FIG. 12A, an alternative aspect is depicted in which a tubular-jacquard knit structure includes a first interlocked course 820A interloopedly coupled to a second interlocked course 820B. The interlocked courses are interloopedly coupled by way of the interlooping of the front-stitch courses and the interlooping of the back-stitch courses. The first and second interlocked courses 820A and 820B include respective intra-course knit sequences 822A and 822B that repeat in the respective interlocked course. Similar to the knit diagram in FIGS. 11A and 11B, the first quantity of front stitches 824A and 824B, the first quantity of back stitches 826A and 826B, the second quantity of front stitches 828A and 828B, and the second quantity of back stitches 830A and 830B are all consistent among each of the respective intra-course knit sequences. And in the alternative aspect depicted in FIG. 12A, the crossing over 832 (which will form the interlocking cross over) in the first interlocked course 820A is positioned at a different needle position as the crossing over 834 in the second interlocked course 820B. Even though the interlocking cross overs are positioned between different pairs of adjacent needle positions, the interlocked courses 820A and 820B include a same density of interlocking cross overs among a given number of repeating intra-course knit sequences, and as such, the interlocked courses 820A and 820B have similar elongation and compression properties when constructing part of a knit textile region. For example, between 16 needle positions that include two sets of repeating intra-course knit sequences, both interlocked courses 820A and 820B include three interlocking cross overs.

Figure 12B:
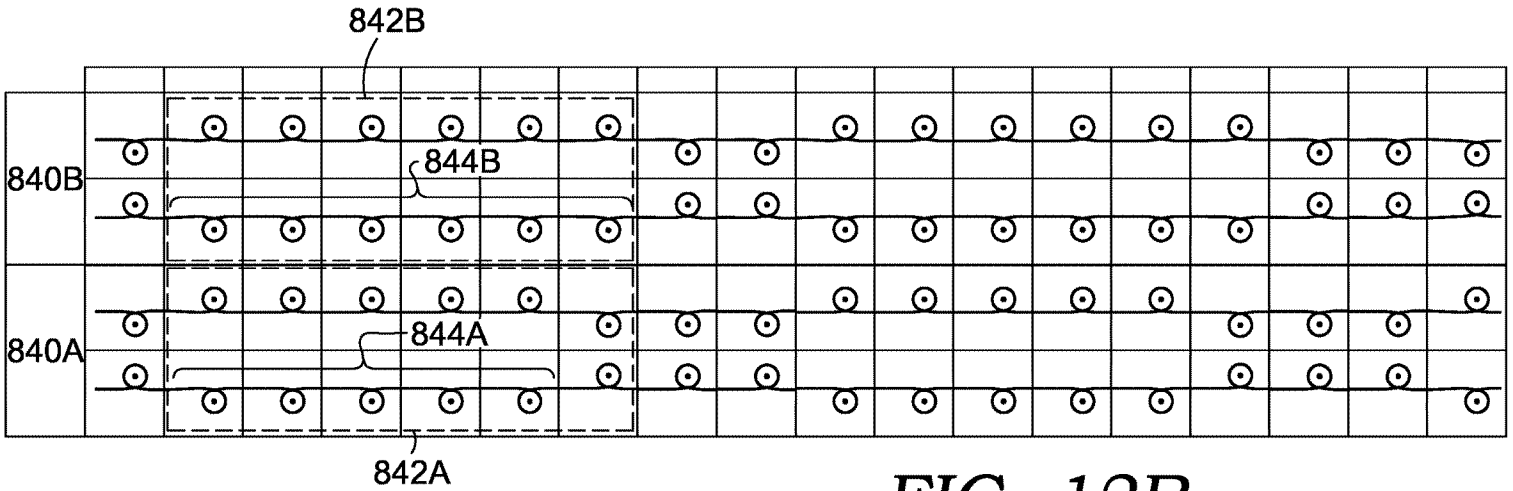

Referring now to FIG. 12B, another alternative aspect is depicted in which a tubular-jacquard knit structure includes a first interlocked course 840A interloopedly coupled to a second interlocked course 840B, and the first and second interlocked courses include respective intra-course knit sequences 842A and 842B that repeat in the respective interlocked course. The knit diagram of FIG. 12B is similar to the knit diagram of FIG. 11B, since the total quantity of stitches in the respective intra-course knit sequences are the same (i.e., eight front stitches and eight back stitches). However, the knit diagram of FIG. 12B is different from the knit diagram in FIGS. 11B and 12A, as subsets of front and back stitches are divided differently in each of the intra-course knit sequences 842A and 842B. For example, the first quantity of front stitches 844A of the intra-course knit sequence 842A is different from the first quantity of front stitches 844B of the intra-course knit sequence 842B. Even though the front and back stitch subsets are divided differently as between the interlocked courses 840A and 840B, the interlocked courses 840A and 840B include a same density of interlocking cross overs among a given number of repeating intra-course knit sequences. For example, both interlocked courses 840A and 840B include three interlocking cross overs among two repeating instances of the respective intra-course knit sequence, which is also consistent with the knit diagrams in FIGS. 11B and 12A. As such the interlocked courses 720A, 820A, and 840A may have similar elongation and compression properties when constructing knit textile regions.

Figure 12C:
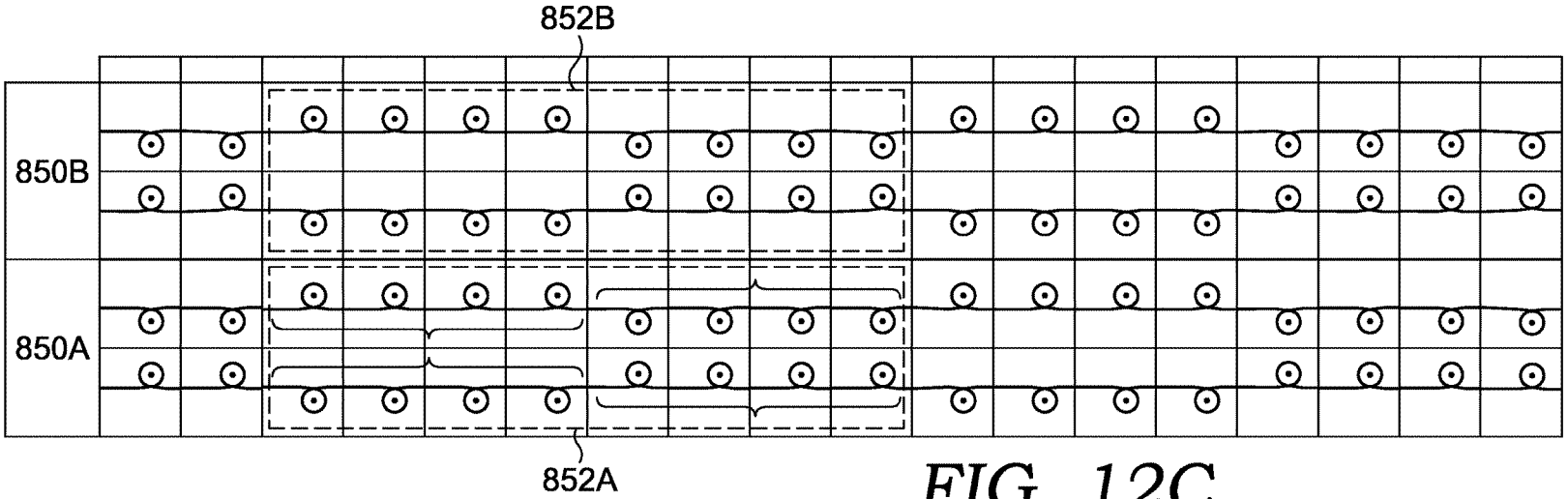

Referring now to FIG. 12C, another alternative aspect is depicted in which a tubular-jacquard knit structure includes a first interlocked course 850A interloopedly coupled to a second interlocked course 850B, and the first and second interlocked courses include respective intra-course knit sequences 852A and 852B that repeat in the respective interlocked course. The knit diagram of FIG. 12C is similar to the knit diagrams of FIGS. 11B, 12A, and 12B in that the total quantity of stitches in the respective intra-course knit sequences are the same (i.e., eight front stitches and eight back stitches). However, the knit diagram of FIG. 8C is different, since in each intra-course knit sequence, the first yarn strand constructs a same number of front stitches and back stitches (i.e., four) as the second yarn strand (i.e., four). As previously indicated, when comparing the interlocked courses of FIG. 12C to the interlocked courses of FIGS. 11B, 12A, and 12B, because the total quantity of stitches in each respective intra-course knit sequence is the same (i.e., eight front stitches and eight back stitches) and the number of interlocking cross overs is the same, the interlocked courses include a same density of interlocking cross overs among a given number repeating instances of intra-course knit sequences. As such the interlocked courses 720A, 820A, 840A, and 850A may have similar elongation and compression properties when constructing knit textile regions.

Figure 12D:
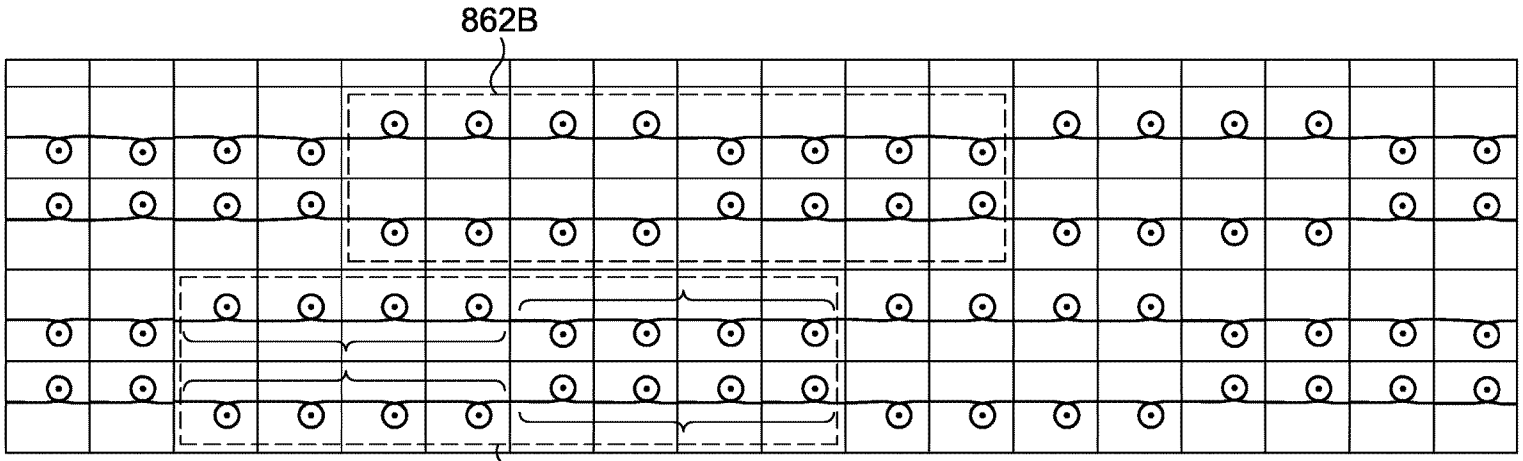

FIG. 12D illustrates a knit diagram that is similar to FIG. 12C, and in each intra-course knit sequence 862A and 862B, the first yarn strand constructs a same number of front stitches and back stitches (i.e., four) as the second yarn strand (i.e., four). But in contrast to knit sequences 852A and 852B of FIG. 12C, the intra-course knit sequences 862A and 862B include respective interlocking cross overs at between different pairs of adjacent needles. However, for the same reasons described with respect to FIG. 12A, the elongation and compression properties may be similar, since the density of interlocking cross overs is similar.

The various intra-course knit sequences illustrated by, and described with respect to, FIGS. 11A, 11B, and 12A-12D include eight front stitches and eight back stitches, and a single interlocking cross over among the eight front and back stitches. In addition, an interlocking cross over is positioned immediately prior to the intra-course knit sequence and immediately after the intra-course knit sequence. In this sense, the intra-course knit sequence is book-ended by interlocking cross overs. The illustration of eight front and back stitches is exemplary of one aspect of the disclosure, and in other aspects, the intra-course knit sequences in the knit textile regions 66 and 68 include a quantity of front stitches that is equal to or greater than four and is equal to or less than twelve. In these other aspects, the same principles described with respect to FIGS. 11A, 11B, and 12A-12D equally apply, such that the interlocking cross over of a single intra-course knit sequence may be arranged between different adjacent needle pairs to divide the front and back stitches into different sized subsets. For example, an intra-course knit sequence having twelve front stitches and twelve back stitches might be broken into two groups of six, a group of five and a group of seven, a group of four and a group of eight, etc. Further, the interlocking cross overs may be positioned between the same adjacent needle pair from one interlocked course to the next, or may be positioned at different adjacent needle pairs as between interlooped courses.

The various knit structures prescribed by FIGS. 11A-12D include a density of interlocking cross overs among a defined quantity of stitches (e.g., a defined set of needle positions). For example, each knit structure in 11B-12D includes two front-stitch courses, each having a quantity of 13 front stitches between the needle positions H and T, and two back-stitch courses, each having 13 back stitches between the needle positions H and T. Further, the quantity of front stitches combined with the quantity of back stitches yields a quantity of 26 stitches. As such, a ratio can describe a quantity of interlocking cross overs relative to a number of stitches in a defined knit textile region. For instance, in each of the knit sequences described by the knit diagrams of FIGS. 11B-12D that include two courses having 13 needle positions, the ratio of the quantity of interlocking cross overs to the quantity of stitches is 3:13. As such, in one aspect of the present disclosure, a ratio of interlocking cross overs to a quantity of stitches may be used to assess and tune an amount of elongation in a knit textile zone.

As indicated above, FIGS. 11B-12D are merely examples of some different intra-course knit sequences having a quantity of eight front stitches and eight back stitches, and in other instances, the intra-course knit sequences may include from four to twelve stitches. Applying the same rationale of characterizing a knit textile region by a ratio of interlocking cross overs to stitches, in one aspect of the present disclosure, the ratio is in a range of about 1:4 to about 1:13.

In accordance with other aspects of the present disclosure, other properties of a knit textile region (e.g., 66 and 68) contribute in-part to an amount of elongation and compression provided by the knit textile region, in addition to the tubular-jacquard knit structure. For example, in one aspect, both the front yarn strand and the back yarn strand include a non-elastic yarn type (also sometimes referred to as a non-stretch yarn), which includes an amount of elasticity that provides a maximum stretch of less than 200% under load prior to returning to a non-stretched state when the load is removed. In a further aspect, the non-elastic yarn type of the first yarn strand and the second yarn strand provides a maximum stretch of less than 100%. Examples of non-elastic yarn types include nylon and polyester. In one aspect of the disclosure, both the first yarn strand and the second yarn strand include two ends of nylon 2/78D/68 (i.e., 2 ply where each ply is 78 decitex with 68 filaments). In contrast, elastic yarn types provide a maximum stretch greater than 200% under load prior to returning to a non-stretched state when the load is removed, and some elastic yarns provide a maximum stretch of about 400%. Examples of elastic yarns include spandex, elastane, lycra, and the like.

When the first yarn strand and the second yarn strand include a non-elastic yarn type, an amount of elongation of the knit textile panel is achievable with the mechanical elongation provided by the interlocking cross overs. Absent this aspect of the disclosure in which non-elastic yarn types are utilized, other solutions may include more elastic yarn types to achieve an amount of elongation.

In accordance with another aspect of the present invention, the stitch length may also contribute to an amount of elongation provided by a knit textile region, in addition to the elongation properties provided by the tubular-jacquard knit structure. For example, the stitch length of the front and back stitches of the knit textile regions might be in a range of about 3.00 mm to about 3.30 mm. And in one aspect of the present invention, the stitch length is 3.15 mm. These stitch lengths are merely exemplary of one aspect of the disclosure, and in other aspects, smaller or larger stitch lengths may be used.

Figure 13:
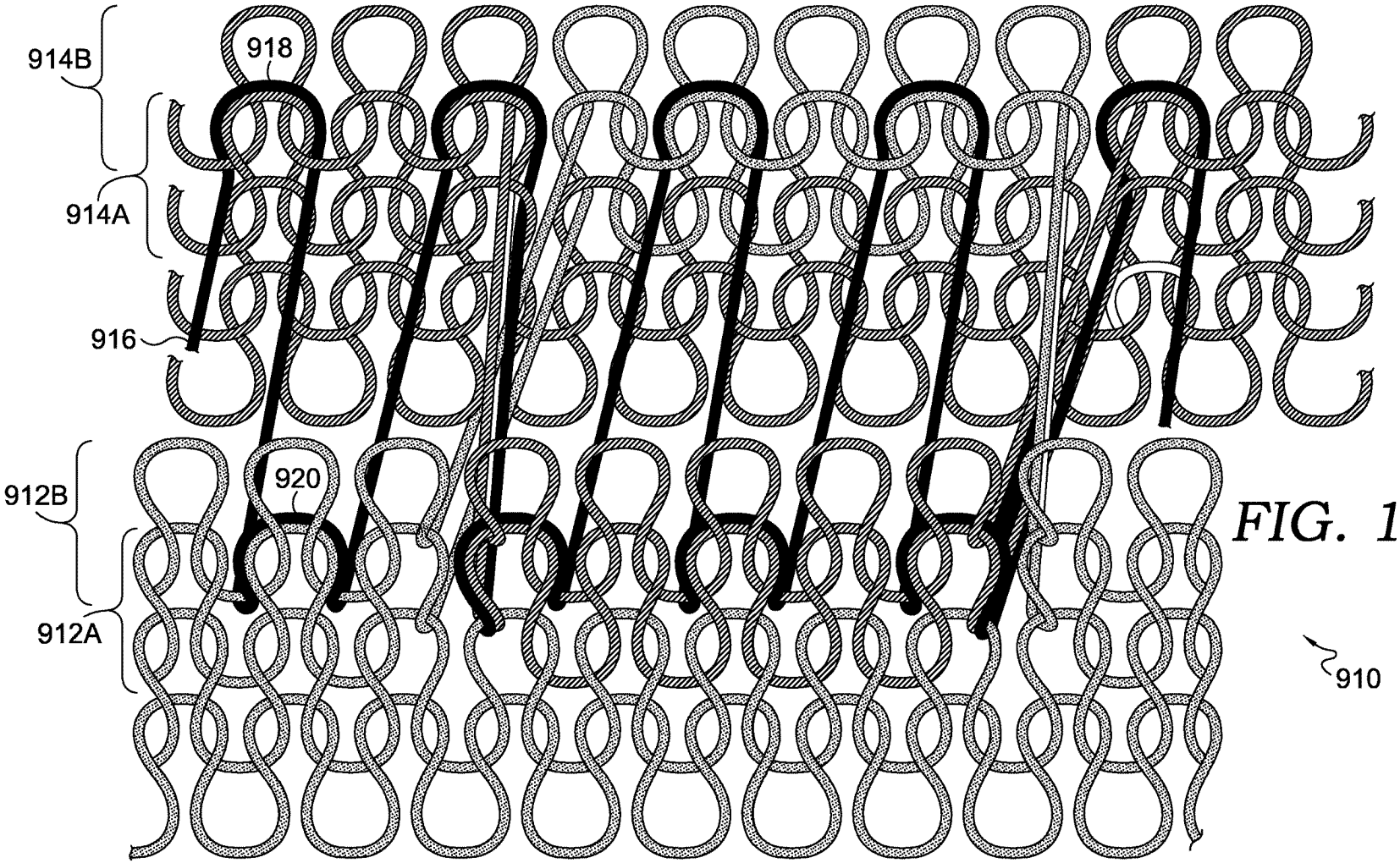
FIG. 13 depicts another exemplary knit schematic, which illustrates a tubular-jacquard knit structure having an interlocking tuck binder, in accordance with an aspect of this disclosure.

Additional knit structures may be integrally knit into the knit textile panel and into the tubular-jacquard knit structure. For example, as explained with respect to FIGS. 4-7, a combination of partial-length courses constructed from a tubular-jacquard knit structure may be intermittently constructed among a knit textile panel to provide a three-dimensional shaping. In another instance, referring to FIG. 13 a tubular-jacquard knit structure 910 is depicted having a plurality of front-stitch courses and a plurality of back-stitch courses. In addition, the front-stitch courses 912A and 912B are intermittently interlocked with the back-stitch courses 914A and 914B, similar to the tubular-jacquard knit structures described with respect to FIGS. 8-12D. As such, the front-stitch course 912A and the back-stitch course 914A form an interlocked course. According to another aspect of the present disclosure, each interlocked course further comprises a course of interlock tuck stitches that further binds a respective front-stitch course 912A to a respective back-stitch course 914B by interlooping with every other front stitch and every other back stitch. As depicted in FIG. 13, a third yarn strand 916 forms a tuck stitch 918 in the back-stitch course 914A and then transfers to the front-stitch course 912A to form another tuck stitch 920. Further, the third yarn strand 916 transfers back and forth between the front-stitch course 912A and the back-stitch course 914A in a sinuous manner to form a tuck stitch at every other front stitch and every other back stitch. To avoid overcrowding FIG. 13, a course of interlock tuck stitches is not depicted in the course formed by the front-stitch course 912B and the back-stitch course 914B, but in other aspects of the disclosure, another course of interlock tuck stitches might bind the front-stitch course 912B with the back-stitch course 914B. Furthermore, the other course of interlock tuck stitches may be offset from the course of interlocking tuck stitches that bind the front-stitch course 912A with the back-stitch course 914A.

Figure 14:
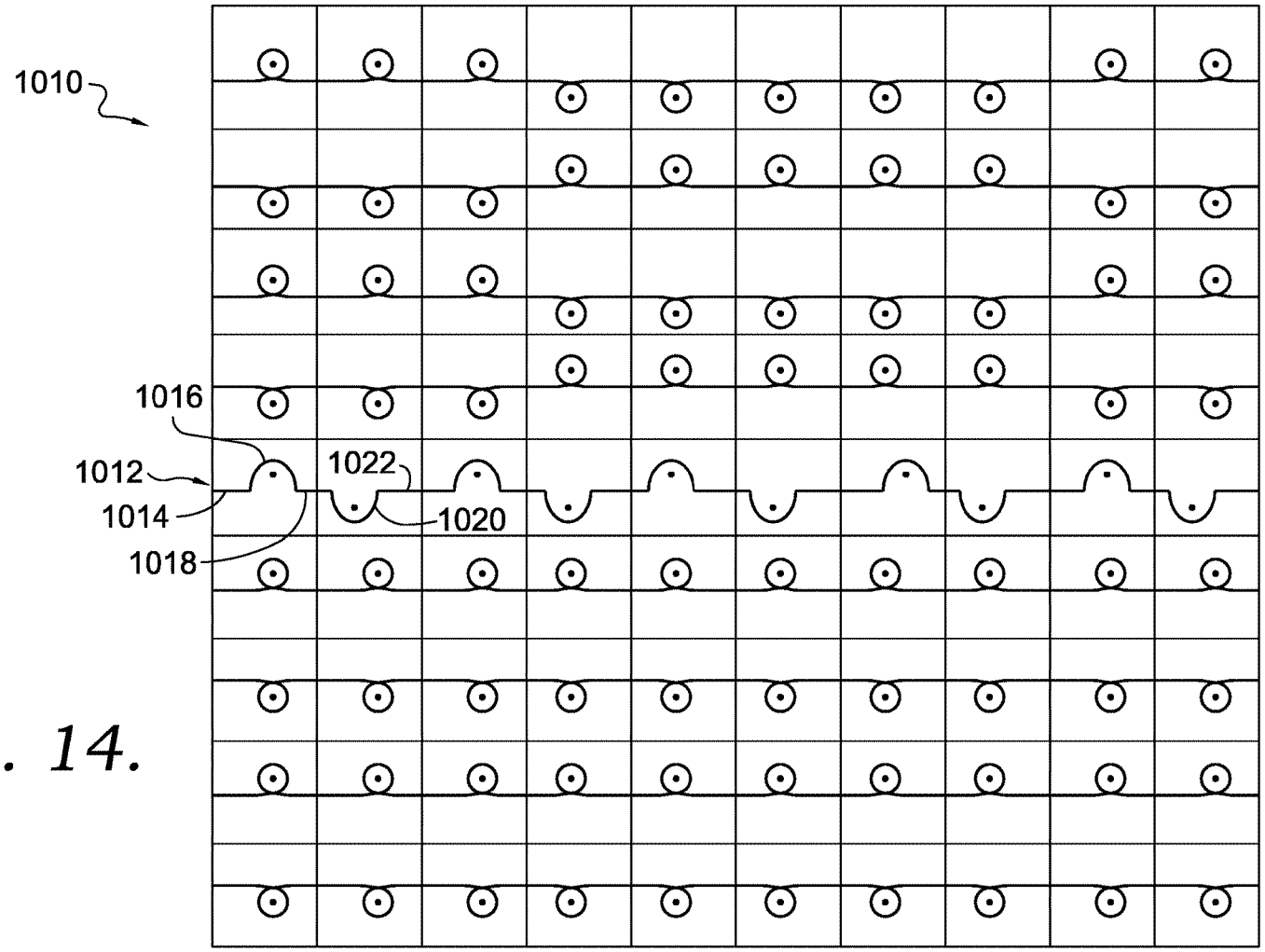
FIG. 14 depicts knit-program notations corresponding with the knit schematic in FIG. 13.

Referring to FIG. 14, a knit diagram 1010 depicts knit notations that, when executed, would result in a knit structure similar to the tubular-jacquard knit structure 910 of FIG. 13. For example, the knit diagram 1010 depicts a row 1012 that prescribes knit structures for the third yarn strand 1014. As described with respect to FIG. 13, the row indicates that the third yarn strand 1014 forms a tuck stitch 1016 on the back side, and then the third yarn strand 1014 transfers 1018 to the front side. The third yarn strand 1014 then forms a tuck stitch 1020 on the front side and transfers 1022 to the back side. This pattern repeats as the third yarn strand 1014 transfers back and forth between the front side and the back side while tuck stitching at every other front stitch and every other back stitch.

Figure 15:
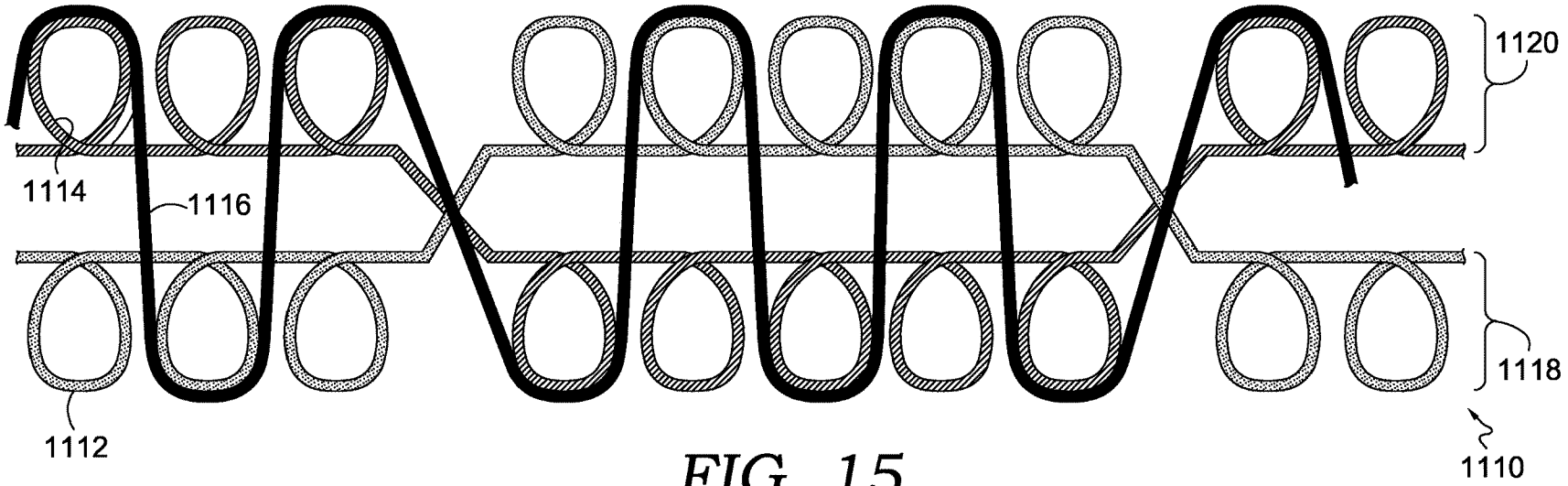
FIG. 15 depicts a knit schematic illustrating an interlocking tuck binder in combination with interlocking cross overs of a front course and a back course in accordance with an aspect of this disclosure.

FIG. 15 provides another illustrative schematic of a tubular-jacquard knit structure 1110 that corresponds with the front-stitch course 912A and the back-stitch course 914B in FIG. 13 and that includes a first yarn strand 1112, a second yarn strand 1114, and a third yarn strand 1116. The first yarn strand 1112 and the second yarn strand 1114 are knit to form a structure similar to the knit structure 310 of FIG. 10A, including a front-stitch course 1118 and a back-stitch course 1120 that intermittently interlock to form an interlocked course. In addition, the third yarn strand 1116 binds the front-stitch course 1118 and the back-stitch course 1120 by constructing a series of interlock tuck stitches at every other front stitch and every other back stitch.

Figure 16:
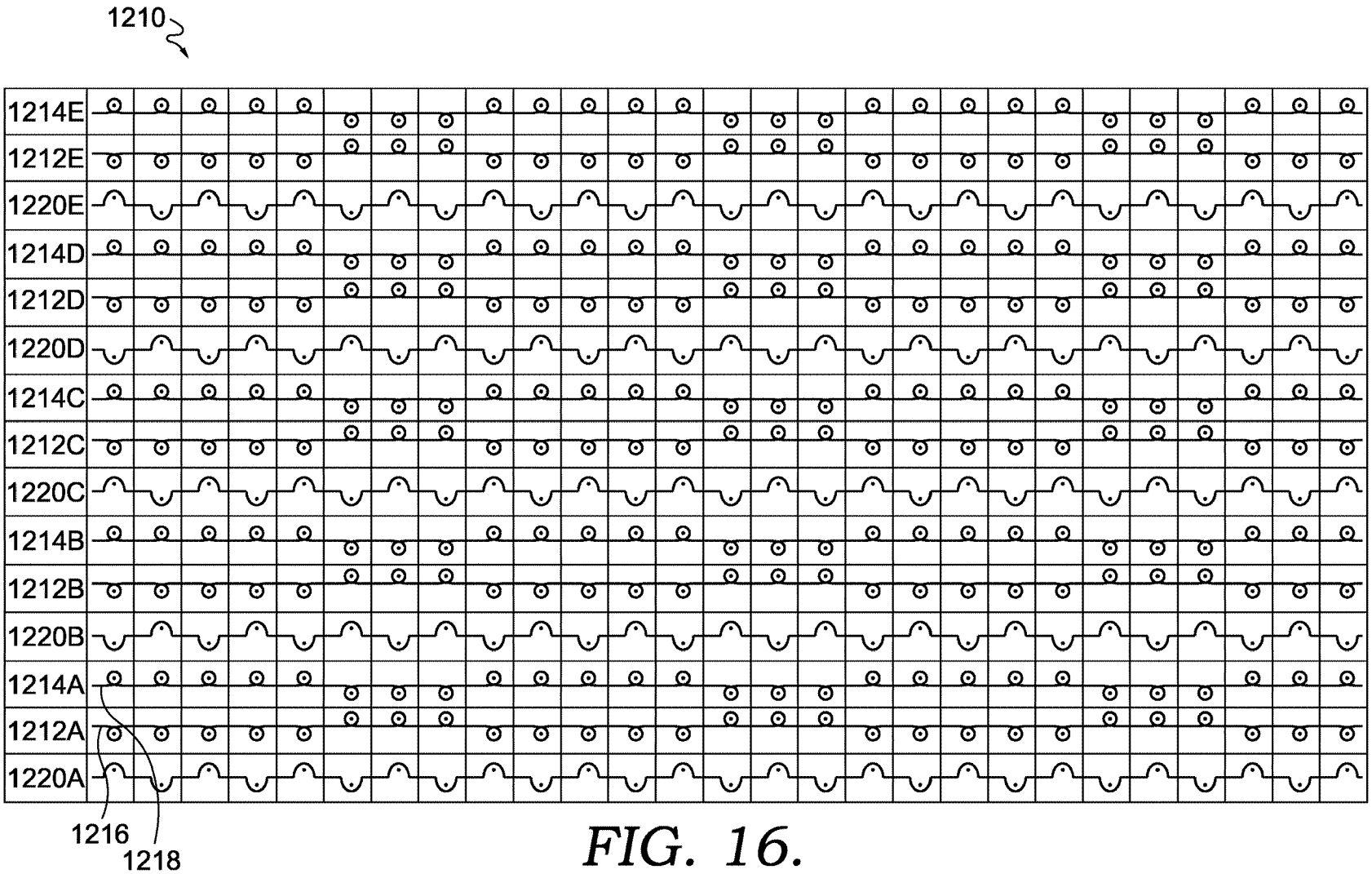
FIG. 16 depicts knit-program notations in accordance with an aspect of this disclosure.

To further illustrate how courses of interlocking tuck stitches might be constructed into a knit textile panel, another knit diagram 1210 is illustrated in FIG. 16. The knit diagram 1210 is similar to the knit diagram 710 of FIG. 11A in some respects. For example, the knit diagram 1210 depicts a series of first-yarn rows 1212A-1212E showing stitch types and location for a first yarn strand 1216 and a series of second-yarn rows 1214A-1214E showing stitch type and location for a second yarn strand 1218. In addition, similar to FIG. 11A, the first yarn strand 1216 and the second yarn strand 1218 construct similar interlocked courses with a repeating intra-course knit sequence having eight front stitches, eight back stitches, and a single interlocking cross over among the eight front and back stitches. In addition, the knit diagram 1210 further depicts a series of third-yarn rows 1220A-1220E that prescribe interlocking tuck stitches in each course that alternate from the front bed to the back bed and that are constructed at every other front stitch and every other back stitch. Furthermore, the knit diagram 1210 indicates that the consecutive courses of interlocking tuck stitches (e.g., 1220A and 1220B) are offset from one another. As such, the needles in course 1220A that are skipped and don't include a tuck stitch will include a tuck stitch in the immediately consecutive course 1220B.

The knit diagram 1210 of FIG. 16 is exemplary of one knit structure that includes an interlocking tuck binder. In other aspects of the present disclosure, each of the various knit structures depicted in FIGS. 12A-12D may also be supplemented to include offset courses of interlocking tuck stitches. Furthermore, each of the additional possible knit combinations described with respect to FIGS. 11A-12D may also include offset courses of interlocking tuck stitches, including intra-course knit sequences with at least four front stitches and back stitches and less than or equal to twelve front stitches and back stitches. In a further aspect, tubular-jacquard knit structures with an interlock tuck binder may include smaller or larger subsets of front and back stitches, as described in other parts of this disclosure.

In a further aspect, the third yarn strand that is used to construct the interlocking tuck stitches includes properties similar to the first yarn strand and the second yarn strand. For example, the third yarn strand includes a non-elastic yarn type (also sometimes referred to as a non-stretch yarn), which includes an amount of elasticity that provides a maximum stretch of less than 200% under load prior to returning to a non-stretched state when the load is removed. In a further aspect, the non-elastic yarn type of the first yarn strand and the second yarn strand provides a maximum stretch of less than 100%. Examples of non-elastic yarn types include nylon and polyester. In one aspect of the disclosure, the third yarn strand include two ends of nylon 2/78D/68 (i.e., 2 ply where each ply is 78 decitex with 68 filaments). Furthermore, the tuck stitches include dimension that facilitate a tightly knit panel, and in one aspect, the tuck stitches include a stitch length in a range of about 2.6 mm to about 3.0 mm.

The interlock tuck binder adds various properties to a knit textile region having the tubular-jacquard knit structures described in this disclosure. For example, the interlock tuck binder retains the front-stitch courses and the back-stitch courses together to yield a flatter knit textile panel that is thrown or pushed wider. Furthermore, the binder helps to facilitate a more tightly knit textile panel. The properties conveyed by the course(s) of interlocking tuck stitches are achieved by the smaller spacing of the tuck stitches as well as the yarn composition (e.g., non-stretch) and size. The course of interlocking tuck stitches differs from some other types of additional knit structures that might be added to a knit structure, such as a spacer knit structure, which often spaces the tuck stitches further apart, utilizes a wider needle-bed spacing, and integrates a larger yarn.

Previously described portions of this disclosure related to FIGS. 4-16 describe various tubular-jacquard knit structures, with partial-length courses, that might construct the knit-textile regions 66 and 68 depicted in FIGS. 1-3. As previously described, these tubular-jacquard knit structures provide an amount of elongation to the knit-textile regions 66 and 68, based at least in part on the density of interlocking cross overs, the yarn composition, the yarn size, the stitch length, or any combination thereof. Accordingly, in an aspect of the disclosure, the amount of elongation translates to a modulus of elasticity that provides an amount of support and compression to an underlying tissue (e.g., breast tissue). A modulus of elasticity may be determined in various manners, and in one aspect, a testing methodology specified by ASTM D 4964-96 may be used. As such, a size of the knit-textile regions 66 and 68 may be configured to include a portion of, or all of, the breast-covering portions 30 and 32, and the size may be determine in various manners, some of which may relate to a size of the upper-torso garment, the breast-covering portions, or a combination thereof.

An aspect of the present disclosure includes upper-torso garments having sizes and dimensions. For example, the upper-torso garment might be a bra having a chest band with a size equal to or greater than 30 inches and equal to or less than 42 inches and a cup size in a range of A to E. In addition, the bra might have a sizing of small, medium, large, x-large, etc. The breast-covering portions 30 and 32 may also have various sizes. For example, at a bottom perimeter edge of the breast-covering portions 30 and 32, where the bottom perimeter edge meets the chest band 50, the bottom perimeter edge of one of the breast-covering portions 30 and 32 might have a length in a range of about 3" to about 5" inches. In another aspect, the bottom perimeter edge of each of the breast-covering portions might have a number of stitches in a range of about 90 stitches to about 120 stitches. For example, the breast-covering portions 30 and 32 in FIGS. 1-3 each include about 104 stitches along the bottom perimeter edge that meets the chest band 50. In addition, the medial perimeter edge of each of the breast-covering portions 30 and 32 that interface with the center bridge 34 might include a length in a range of about 3.5" inches to about 5.5" inches. And in another aspect, the medial perimeter edge of each of the breast-covering portions 30 and 32 might include a number of courses in a range of about 150 to about 240.

Having described some exemplary sizes and dimensions of an upper-torso garment, another aspect of the disclosure relates to the size of the knit-textile regions 66 and 68 that include a tubular-knit textile and that are positioned in the breast-covering regions 30 and 32. This relative sizing between the knit-textile panels 66 and 68 and the breast-covering portion 30 and 32 may, at least in part, determine the extent to which the elongation properties provided by the knit-textile panel are transferred to the breast-covering portions 30 and 32.

A size of a knit-textile region 66 and 68 may be determined by various metrics. For example, the knit-textile regions 66 and 68 may include a polygonal shape having measured sides, and in one aspect the knit-textile regions 66 and 68 are at least 1" by 1" square. And in another aspect, the knit-textile panels 66 and 68 include a size that corresponds with at least some of the dimensions of the breast-covering regions 30 and 32, such that a base perimeter edge abutting the chest band is in a range of about 3" to about 5", and a medial edge abutting the medial region is in a range of about 3.5" to about 5.5". These dimensions are exemplary of one aspect of the present invention, and in other aspects the dimensions of the knit textile region may be smaller than the range listed. These dimensions of the knit textile region may also be larger than the listed range.

In a further aspect of the disclosure, a size of the knit-textile regions 66 and 68 might be based on a number of courses and stitches. For instance, in one aspect, the knit-textile regions 66 and 68 include a quantity of interlocked courses in a range of about 40 courses to about 120 courses, each interlocked course including a front-stitch course and a back-stitch course. In a further aspect, such as when the knit-textile panel includes a size that corresponds with the medial edge of the breast-covering portion 30 and 32 each knit-textile region 66 and 68 includes a quantity of courses in a range of about 150 courses to about 240 courses. In addition, each of these courses in the quantity includes a respective intra-knit sequence that repeats along the interlocked course. Based on the size of the intra-course knit sequence (e.g., between four and twelve stitches) and based on the number of times the intra-course knit sequence repeats, another dimension of the knit textile panel can be determined based on the total number of stitches in a respective course. For example, as previously indicated, an intra-course knit sequence might have a quantity of stitches equal to or greater than four and less than or equal to twelve, and the sequence might repeat between five and ten times. Using these exemplary numbers, a width of a knit textile region might be between 20 stitches and 120 stitches. And in a further aspect, such as when the knit-textile panel includes a size that corresponds with the bottom perimeter edge of the breast-covering portion 30 and 32 each knit-textile region 66 and 68 may include a quantity of stitches in a range of about 80 to about 120.

As described in other parts of this disclosure, a number of interlocking cross overs in a course or in a knit textile panel can be increased to lower the modulus of elasticity and can be decreased to increase the modulus of elasticity. As such, an aspect of the present invention includes an upper-torso garment that includes a first knit zone having a first modulus of elasticity and a second knit zone having a second modulus of elasticity, which is greater than the first modulus of elasticity. Furthermore, the first knit zone is constructed of a first tubular-jacquard knit structure, and the second knit zone is constructed of a second tubular-jacquard knit structure. The first and second tubular-jacquard knit structures both include a plurality of front-stitch courses that are intermittently interlocked with a plurality of back-stitch courses. However, the density of the interlocking cross overs in the second tubular-jacquard knit structure is lower than the density of the interlocking cross overs in the first tubular-jacquard knit structure, and the lower density increases the modulus of elasticity by lowering the elongation provided by the fewer number of interlocking cross overs. This aspect of the present disclosure allows different regions of the upper-torso garment to be constructed of the same yarn type, same yarn size, same stitch structures, and different zonal properties based on the density of the interlocking cross overs.

An upper-torso garment having one or more of the aspects described in this disclosure may be constructed in various manners. For instance, a flat-bed knitting machine may be used, having a front needle bed and a back needle bed, such as a commercially available V-bed knitting machine. Knitting machines having various bed gauges may be used, and in one aspect, an 18 gauge bed is used to construct an upper-torso garment. Furthermore, various size needles may be used, such as 14 gauge, 16, gauge, 18 gauge, etc., and in one aspect, 16 gauge needles are used on an 18 gauge needle bed.

The entire upper-torso garment may be knit as a single integrated piece, which is then coupled together at particular locations to create a left side, right side, anterior portion, and posterior portion. In addition, certain parts of the upper-torso garment may be knit separately from one another and then coupled to form the upper-torso garment. In one aspect, the anterior portion with straps is constructed separately from the posterior portion and the two pieces are then coupled to form the upper-torso garment. For example, at least part of the anterior portion may be constructed with all non-elastic yarns, whereas elastic yarns may be knit into the posterior portion. The anterior portion may then be coupled to the posterior portion. These manufacturing aspects are merely exemplary, and various other techniques may also be utilized.

Having described various aspects illustrated in FIGS. 1-16, as well as alternative aspects, some additional aspects will now be described that draw on one or more of the illustrated, or alternative aspects. As such, one further aspect of the present disclosure is directed to an upper-torso garment having a breast-covering portion and a pair of dome-shaped portions that are located in the breast-covering portion. The pair of dome-shaped portions are separated from one another by a center bridge, and each dome-shaped portion is divisible into a top half and a bottom half. Furthermore, each dome-shaped portion includes a medial perimeter edge, which abuts the center bridge, and lateral perimeter edge. The upper-torso garment includes a knit textile panel constructing each of the dome-shaped portions, the knit textile panel comprising a plurality of courses fully spanning the dome-shaped portion from the medial perimeter edge to the lateral perimeter edge. Furthermore, the upper-torso garment includes a plurality of partial-length courses partially spanning the dome-shaped portion. The plurality of partial-length courses are intermittently positioned among the plurality of courses, and the plurality of partial-length courses are unevenly distributed between the top half and the bottom half.

Another aspect of the present disclosure is directed to an upper-torso garment having a breast-covering portion and a pair of dome-shaped portions that are located in the breast-covering portion. The pair of dome-shaped portions are separated from one another by a center bridge, and each dome-shaped portion is divisible into a top half and a bottom half. Furthermore, each dome-shaped portion includes a medial perimeter edge, which abuts the center bridge, and lateral perimeter edge. The upper-torso garment includes a knit textile panel constructing each of the dome-shaped portions, the knit textile panel comprising a plurality of courses fully spanning the dome-shaped portion from the medial perimeter edge to the lateral perimeter edge. Furthermore, the upper-torso garment includes a plurality of partial-length courses partially spanning the dome-shaped portion. The plurality of partial-length courses are intermittently positioned among the plurality of courses, and the plurality of partial-length includes a larger distribution of partial-length courses in the bottom half than in the top half.

A further aspect of the present disclosure is directed to an upper-torso garment having a breast-covering portion and a pair of dome-shaped portions that are located in the breast-covering portion. The pair of dome-shaped portions are separated from one another by a center bridge, and each dome-shaped portion is divisible into a top half and a bottom half. Furthermore, each dome-shaped portion includes a medial perimeter edge, which abuts the center bridge, and lateral perimeter edge. The upper-torso garment includes a knit textile panel constructing each of the dome-shaped portions, the knit textile panel comprising a plurality of courses fully spanning the dome-shaped portion from the medial perimeter edge to the lateral perimeter edge. Furthermore, the upper-torso garment includes a plurality of partial-length courses partially spanning the dome-shaped portion. The plurality of partial-length courses are intermittently positioned among the plurality of courses, and the plurality of partial-length includes a larger distribution of partial-length courses in the top half than in the bottom half.

From the foregoing, it will be seen that this subject matter is adapted to attain ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made of the subject matter without departing from the scope thereof, it is to be understood that all matter herein set forth or shown in the accompanying drawings is to be interpreted as illustrative and not in a limiting sense.

The invention claimed is:

1. An upper-torso garment having a chest-covering portion, the upper-torso garment comprising:

a pair of dome-shaped portions that are located in the chest-covering portion and that are separated from one another by a center bridge, wherein each dome-shaped portion is divisible into a top half and a bottom half and includes a medial perimeter edge, which abuts the center bridge, and a lateral perimeter edge;

a knit textile panel constructing each of the dome-shaped portions, the knit textile panel comprising a plurality of courses fully spanning the dome-shaped portion from the medial perimeter edge to the lateral perimeter edge; and a plurality of partial-length courses partially spanning the dome-shaped portion, wherein the plurality of partial-length courses are intermittently positioned among the plurality of courses, and wherein the plurality of partial-length courses are unevenly distributed between the top half and the bottom half, wherein each partial-length course of the plurality of partial-length courses includes a medial terminal end spaced apart from the medial perimeter edge by a first quantity of stitches and includes a lateral terminal end spaced apart from the lateral perimeter edge by a second quantity of stitches, and wherein the first quantity of stitches is less than the second quantity of stitches.

2. The upper-torso garment of claim 1, wherein a larger quantity of partial-length courses are located in the top half than the bottom half.

3. The upper-torso garment of claim 1, wherein a larger quantity of partial-length courses are located in the bottom half than the top half.

4. The upper-torso garment of claim 1, wherein the plurality of partial-length courses includes a first partial-length course having a first length, a second partial-length course having a second length that is shorter than the first length, and a third partial-length course having a third length that is shorter than the second length; and wherein the second partial-length course is positioned between the first and third partial-length courses and the third partial-length course is positioned closer to a chest band of the upper-torso garment than the second partial-length course.

5. The upper-torso garment of claim 1, wherein the plurality of partial-length courses includes a first partial-length course having a first length, a second partial-length course having a second length that is shorter than the first length, and a third partial-length course having a third length that is shorter than the second length; and wherein the second partial-length course is positioned between the first and third partial-length courses and the first partial-length course is positioned closer to a chest band of the upper-torso garment than the second partial-length course.

6. The upper-torso garment of claim 1, wherein the plurality of partial-length courses includes a first partial-length course having a first length, a second partial-length course having a second length that is shorter than the first length, and a third partial-length course having a third length that is longer than the second length; and wherein the second partial-length course is positioned between the first and third partial-length courses.

7. The upper-torso garment of claim 1, wherein the knit textile panel comprises a tubular-jacquard knit structure having a plurality of front-stitch courses and a plurality of back-stitch courses constructed of a first yarn strand and a second yarn strand, and wherein each front-stitch course intermittently interlocks with a back-stitch course by the first yarn strand and the second yarn strand transferring back and forth between the front-stitch course to the back-stitch course.

8. The upper-torso garment of claim 7, wherein a third yarn strand constructs a course of interlock tuck stitches that binds the front-stitch course to the back-stitch course by interlooping with every other front stitch and every other back stitch.

9. An upper-torso garment having a chest-covering portion, the upper-torso garment comprising:

a pair of dome-shaped portions that are located in the chest-covering portion and that are separated from one another by a center bridge, wherein each dome-shaped portion is divisible into a top half and a bottom half and includes a medial perimeter edge, which abuts the center bridge, and a lateral perimeter edge;

a knit textile panel constructing each of the dome-shaped portions, the knit textile panel comprising a plurality of courses fully spanning the dome-shaped portion from the medial perimeter edge to the lateral perimeter edge; and a plurality of partial-length courses partially spanning the dome-shaped portion, wherein the plurality of partial-length courses are intermittently positioned among the plurality of courses, wherein the plurality of partial-length courses each includes a medial terminal end that is spaced apart from the center bridge by a respective medial distance and includes a lateral terminal end that is spaced apart from the lateral perimeter edge by a respective lateral distance, and wherein the respective medial distance is shorter than the respective lateral distance.

10. The upper-torso garment of claim 9, wherein the upper-torso garment is a bra having a chest-band size equal to or less than 32 inches and a cup size that is equal to or less than C.

11. The upper-torso garment of claim 9, wherein the knit textile panel comprises a tubular-jacquard knit structure having a plurality of front-stitch courses and a plurality of back-stitch courses constructed of a first yarn strand and a second yarn strand, and wherein each front-stitch course intermittently interlocks with a back-stitch course by the first yarn strand and the second yarn strand transferring back and forth between the front-stitch course to the back-stitch course.

12. The upper-torso garment of claim 11, wherein a third yarn strand constructs a course of interlock tuck stitches that binds the front-stitch course to the back-stitch course by interlooping with every other front stitch and every other back stitch.

13. An upper-torso garment having a chest-covering portion, the upper-torso garment comprising:

a pair of dome-shaped portions that are located in the chest-covering portion and that are separated from one another by a center bridge, wherein each dome-shaped portion is divisible into a top half and a bottom half and includes a medial perimeter edge, which abuts the center bridge, and a lateral perimeter edge;

a knit textile panel constructing each of the dome-shaped portions, the knit textile panel comprising a plurality of courses fully spanning the dome-shaped portion from the medial perimeter edge to the lateral perimeter edge; and a plurality of partial-length courses partially spanning the dome-shaped portion, wherein the plurality of partial-length courses are intermittently positioned among the plurality of courses, and wherein the plurality of partial-length courses includes a larger distribution of partial-length courses in the top half than the bottom half, wherein the plurality of partial-length courses each includes a medial terminal end that is spaced apart from the center bridge by a respective medial distance and includes a lateral terminal end that is spaced apart from the lateral perimeter edge by a respective lateral distance, and wherein the respective medial distance is shorter than the respective lateral distance.

14. The upper-torso garment of claim 13, wherein the upper-torso garment is a bra having a chest-band size greater than 32 inches and a cup size greater than C.

15. The upper-torso garment of claim 13, wherein the upper-torso garment includes a pair of shoulder straps, each of which includes a respective shoulder-strap midline reference plane, and wherein the shoulder-strap midline reference plane intersects the plurality of partial-length courses.

16. The upper-torso garment of claim 13, wherein the knit textile panel comprises a tubular-jacquard knit structure having a plurality of front-stitch courses and a plurality of back-stitch courses constructed of a first yarn strand and a second yarn strand, and wherein each front-stitch course intermittently interlocks with a back-stitch course by the first yarn strand and the second yarn strand transferring back and forth between the front-stitch course to the back-stitch course.

17. The upper-torso garment of claim 16, wherein a third yarn strand constructs a course of interlock tuck stitches that binds the front-stitch course to the back-stitch course by interlooping with every other front stitch and every other back stitch.

* * * * *